US012338094B2

(12) United States Patent
Aoyama et al.

(10) Patent No.: US 12,338,094 B2
(45) **Date of Patent: *Jun. 24, 2025**

(54) IMAGE FORMING APPARATUS

(71) Applicants: Jumpei Aoyama, Kanagawa (JP); Manabu Nonaka, Kanagawa (JP); Hajime Nishida, Kanagawa (JP); Hideki Tobinaga, Kanagawa (JP); Junpei Kamichi, Tokyo (JP); Satoshi Kuno, Tokyo (JP); Shun Kobayashi, Kanagawa (JP)

(72) Inventors: Jumpei Aoyama, Kanagawa (JP); Manabu Nonaka, Kanagawa (JP); Hajime Nishida, Kanagawa (JP); Hideki Tobinaga, Kanagawa (JP); Junpei Kamichi, Tokyo (JP); Satoshi Kuno, Tokyo (JP); Shun Kobayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/304,023

(22) Filed: Apr. 20, 2023

(65) Prior Publication Data

US 2023/0249931 A1 Aug. 10, 2023

Related U.S. Application Data

(60) Division of application No. 17/177,293, filed on Feb. 17, 2021, now Pat. No. 11,667,484, which is a (Continued)

(30) Foreign Application Priority Data

Mar. 5, 2014 (JP) ..... 2014-042805
Sep. 22, 2014 (JP) ..... 2014-192213

(51) Int. Cl.
*B65H 3/56* (2006.01)
*B65H 1/26* (2006.01)
*B65H 3/52* (2006.01)

(52) U.S. Cl.
CPC ..... *B65H 3/56* (2013.01); *B65H 1/266* (2013.01); *B65H 3/5215* (2013.01); (Continued)

(58) Field of Classification Search
CPC ..... B65H 3/52; B65H 3/5246; B65H 3/5253; B65H 3/5261; B65H 3/56
See application file for complete search history.

(56) References Cited

U.S. PATENT DOCUMENTS 4,515,358 A 5/1985 Fukui
4,852,868 A 8/1989 Fukui et al.
(Continued)

FOREIGN PATENT DOCUMENTS

JP S63-56137 U 4/1988
JP H3-259829 A 11/1991
(Continued)

OTHER PUBLICATIONS

Office Action for Japanese Patent Application No. 2014-192213 issued on Apr. 27, 2018.
(Continued)

*Primary Examiner* — Patrick Cicchino
(74) *Attorney, Agent, or Firm* — Harness, Dickey & Pierce, P.L.C.

(57) ABSTRACT

An image forming apparatus includes a sheet container accommodating a recording medium therein, a sheet separating feeder including a sheet feeding body and a sheet separating body, an image forming part, and a bend applier. The sheet feeding body feeds the recording medium along with a surface movement thereof while the recording
(Continued)

medium contacting the surface thereof. The sheet separating body forms a sheet separation nip region with the sheet feeding body and sandwiches the recording medium in the sheet separation nip region. The sheet separating feeder separates and feeds the recording medium contacting the sheet feeding body. The image forming part forms an image on the recording medium. The bend applier having a leading end of an elastic material contacts and bends the recording medium before the sheet separation nip region and generates a wrinkle extending on the recording medium in a sheet conveying direction.

17 Claims, 24 Drawing Sheets

Related U.S. Application Data continuation of application No. 16/157,196, filed on Oct. 11, 2018, now Pat. No. 10,968,061, which is a continuation of application No. 14/638,375, filed on Mar. 4, 2015, now Pat. No. 10,202,250.

(52) U.S. Cl.
CPC ..... *B65H 2301/51214* (2013.01); *B65H 2402/10* (2013.01); *B65H 2402/31* (2013.01); *B65H 2402/32* (2013.01); *B65H 2402/54* (2013.01); *B65H 2404/114* (2013.01); *B65H 2404/117* (2013.01); *B65H 2404/1521* (2013.01); *B65H 2405/313* (2013.01); *B65H 2511/17* (2013.01); *B65H 2601/324* (2013.01)

(56) References Cited

U.S. PATENT DOCUMENTS

| | | | | |
|---|---|---|---|---|
| 5,026,042 | A | 6/1991 | Miller | |
| 5,961,226 | A | 10/1999 | Nishida | |
| 5,992,993 | A | 11/1999 | Kiyohara et al. | |
| 6,086,062 | A | 7/2000 | Nakamura et al. | |
| 6,102,389 | A | 8/2000 | Sakurai et al. | |
| 6,120,018 | A * | 9/2000 | Amano | B65H 3/0669 271/121 |
| 6,371,477 | B1 | 4/2002 | Lin | |
| 6,536,759 | B1 * | 3/2003 | Takada | B65H 3/5261 271/37 |
| 7,040,614 | B2 | 5/2006 | Sonoda et al. | |
| 7,731,177 | B2 | 6/2010 | Ikeda | |
| 7,841,593 | B2 | 11/2010 | Toba et al. | |
| 7,866,659 | B2 | 1/2011 | Izumichi et al. | |
| 8,770,575 | B2 * | 7/2014 | Yuasa | B65H 3/68 271/121 |
| 9,403,650 | B2 | 8/2016 | Katsura et al. | |
| 9,625,866 | B2 | 4/2017 | Aoyama et al. | |
| 9,856,099 | B2 | 1/2018 | Aoyama et al. | |
| 2003/0155702 | A1 | 8/2003 | Togashi et al. | |
| 2003/0160381 | A1 | 8/2003 | Sonoda et al. | |
| 2005/0253323 | A1 | 11/2005 | Fujita et al. | |
| 2005/0254872 | A1 | 11/2005 | Nonaka et al. | |
| 2006/0127149 | A1 | 6/2006 | Togashi et al. | |
| 2006/0132573 | A1 | 6/2006 | Nishida | |
| 2006/0181589 | A1 | 8/2006 | Nishida | |
| 2006/0181590 | A1 | 8/2006 | Nonaka | |
| 2007/0057429 | A1 | 3/2007 | Watanabe et al. | |
| 2007/0127090 | A1 | 6/2007 | Nonaka | |
| 2008/0006995 | A1 | 1/2008 | Nonaka | |
| 2010/0109227 | A1 | 5/2010 | Higaki et al. | |
| 2013/0230338 | A1 | 9/2013 | Kubo et al. | |
| 2013/0341851 | A1 * | 12/2013 | Mitamura | B65H 9/08 271/226 |
| 2014/0183813 | A1 | 7/2014 | Aoyama | |
| 2014/0210157 | A1 | 7/2014 | Aoyama | |
| 2014/0212195 | A1 | 7/2014 | Aoyama | |
| 2015/0115520 | A1 | 4/2015 | Uohashi | |
| 2015/0132040 | A1 * | 5/2015 | Aoyama | G03G 15/6511 399/398 |

FOREIGN PATENT DOCUMENTS

| | | | |
|---|---|---|---|
| JP | H04-1326 | A | 1/1992 |
| JP | H05-297780 | A | 11/1993 |
| JP | H6-255810 | A | 9/1994 |
| JP | H7-215508 | A | 8/1995 |
| JP | 2000-296933 | A | 10/2000 |
| JP | 2001-088970 | A | 4/2001 |
| JP | 2001-163472 | A | 6/2001 |
| JP | 2002-307737 | A | 10/2002 |
| JP | 2003-002460 | A | 1/2003 |
| JP | 2004-010273 | A | 1/2004 |
| JP | 2005-247537 | A | 9/2005 |
| JP | 2006-089219 | A | 4/2006 |
| JP | 2006-168839 | A | 6/2006 |
| JP | 2007-230766 | A | 9/2007 |
| JP | 2008-039840 | A | 2/2008 |
| JP | 2012-103627 | A | 5/2012 |
| JP | 2012-166912 | A | 9/2012 |

OTHER PUBLICATIONS

U.S. Appl. No. 14/533,449, filed Nov. 5, 2014.
U.S. Appl. No. 14/536,955, filed Nov. 10, 2014.
Office Action for Japanese Patent Application No. 2018-196625 issued on Dec. 28, 2018.
Office Action for Japanese Patent Application No. 2019-143501 issued on Nov. 6, 2020.

* cited by examiner

IMAGE FORMING APPARATUS

CROSS-REFERENCE TO RELATED APPLICATIONS

This patent application is a divisional of and claims priority under 35 U.S.C. §§ 120/121 to U.S. application Ser. No. 17/177,293, filed on Feb. 17, 2021, which is a continuation of and claims priority under 35 U.S.C. §§ 120/121 to U.S. application Ser. No. 16/157,196, filed on Oct. 11, 2018, which is a continuation of and claims priority under 35 U.S.C. §§ 120/121 to U.S. application Ser. No. 14/638,375, filed on Mar. 4, 2015, which claims priority pursuant to 35 U.S.C. § 119(a) to Japanese Patent Application Nos. 2014-042805, filed on Mar. 5, 2014, and 2014-192213, filed on Sep. 22, 2014, in the Japan Patent Office, the entire disclosures of each of which are hereby incorporated by reference herein.

BACKGROUND

Technical Field

This disclosure relates to an image forming apparatus in which a sheet or a recording medium of a sheet bundle that is contained in a sheet container is fed therefrom by a surface movement of a sheet feeding body to which the sheet is pressed, and is separated from the other sheets of the sheet bundle in a separation nip region formed by a contact of the sheet feeding body and a sheet separating body.

Related Art

As an example of known image forming apparatus, some image forming apparatuses do not include a pickup roller and causes a sheet feed roller to function as a pickup roller. This configuration can achieve a reduction of cost without a pickup roller.

For example, in this configuration, a comparative sheet tray of a known image forming apparatus accommodates multiple sheets as a sheet bundle therein. A sheet feed roller is disposed in the vicinity of the sheet tray. The leading end of the sheet bundle contained in the sheet tray is biased by a movable bottom plate of the sheet tray to an upward direction, so that the leading end of the sheet bundle contacts the sheet feed roller to form a pressed region. In the vicinity of the pressed region, the sheet feed roller and a sheet separating roller are in contact with each other to form a sheet separation nip region.

As the sheet feed roller rotates, an uppermost sheet placed on top of the sheet bundle is fed from the sheet tray toward the sheet separation nip region. At this time, a subsequent sheet or subsequent sheets immediately below the uppermost sheet may be fed together with the uppermost sheet from the sheet tray. This sheet feeding operation is called as "multifeed". When multiple sheets are held in the sheet separation nip region due to the misfeed, the uppermost sheet directly contacting the sheet feed roller is fed in a sheet feeding direction along with movement of a surface of the sheet feed roller. By contrast, the other sheets such as the subsequent sheet(s) are conveyed by the sheet separating roller to return to the sheet tray along with movement of a surface thereof in an opposite direction to the sheet feed roller in the sheet separation nip region. According to this conveyance back to the sheet tray, even when multifeed occurs, a single sheet, i.e., the uppermost sheet, which directly contacts the sheet feed roller is separated from the other sheets in the sheet bundle. Thereafter, the uppermost sheet is conveyed toward an image forming part of the image forming apparatus.

SUMMARY

At least one aspect of this disclosure provides an image forming apparatus including a sheet container, a sheet separating feeder, an image forming part, and a bend applier. The sheet container accommodates a sheet bundle including a recording medium therein. The sheet separating feeder includes a sheet feeding body and a sheet separating body. The sheet feeding body feeds the recording medium from the sheet container along with movement of a surface thereof while the recording medium contained in the sheet container is in contact with the surface thereof. The sheet separating body forms a sheet separation nip region by contacting the sheet feeding body and sandwiches the recording medium in the sheet separation nip region. The sheet separating feeder separates and feeds the recording medium in contact with the sheet feeding body. The image forming part forms an image on the recording medium fed and separated by the sheet separating feeder. The bend applier contacts and bends the recording medium before the recording medium enters the sheet separation nip region and generates a wrinkle extending on the recording medium in a sheet conveying direction. The bend applier has a leading end of an elastic material to contact the recording medium.

DETAILED DESCRIPTION

Figure 1:
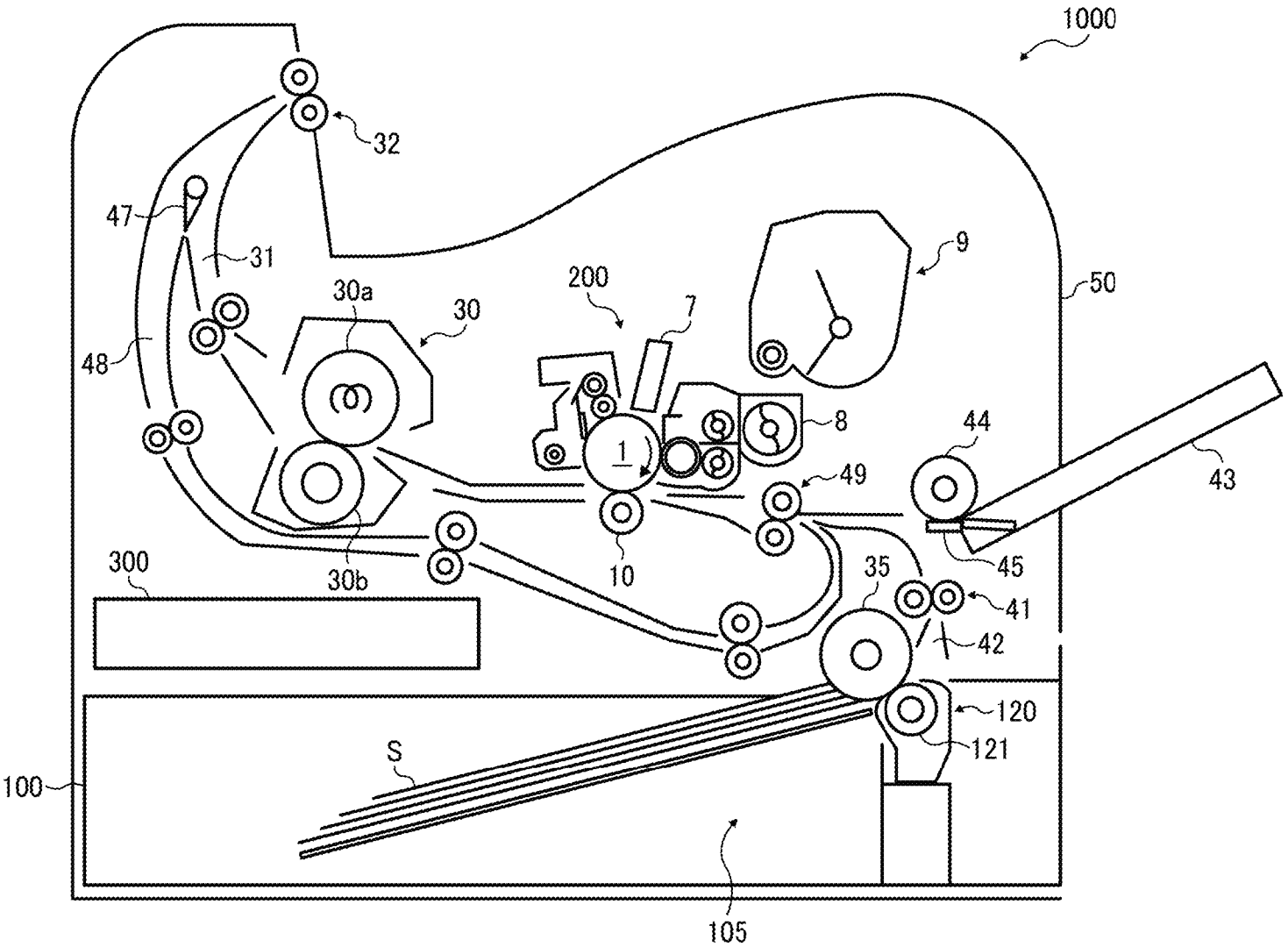
FIG. 1 is a diagram illustrating a schematic configuration of an image forming apparatus according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an electrophotographic image forming apparatus 1000 for forming images by electrophotography.

The image forming apparatus 1000 may be a copier, a printer, a scanner, a facsimile machine, a plotter, and a multifunction peripheral or a multifunction printer (MFP) having at least one of copying, printing, scanning, facsimile, and plotter functions, or the like. According to the present example, the image forming apparatus 1000 is an electrophotographic printer that forms toner images on a sheet or sheets by electrophotography.

Further, it is to be noted that this disclosure is also applicable to image forming apparatuses adapted to form images through other schemes, such as known ink jet schemes, known toner projection schemes, or the like as well as to image forming apparatuses adapted to form images through electro-photographic schemes.

It is also to be noted in the following examples that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, sheet member, and recording material to which the developer or ink is attracted.

At first, a description is given of a basic configuration of the image forming apparatus 1000 according to an example of this disclosure.

FIG. 1 is a schematic diagram illustrating the image forming apparatus 1000 according to this example.

In FIG. 1, the present image forming apparatus 1000 includes an apparatus body 50, a photoconductor 1, and a sheet tray 100. The photoconductor 1 functions as a latent image bearer. The sheet tray 100 functions as a sheet container that is detachably attachable to the apparatus body 50.

The sheet tray 100 includes multiple sheets S in a form of a sheet bundle.

A sheet S in the sheet tray 100 is fed from the sheet tray 100 as a sheet feed roller 35 rotates, passes through a sheet separation nip region, and reaches a sheet conveying path 42. Thereafter, the sheet S is held by a first conveying roller pair 41 in the sheet conveying nip region and is conveyed from an upstream side toward a downstream side in the sheet conveying direction in the sheet conveying path 42. A registration roller pair 49 is disposed in a vicinity of a terminal end of the sheet conveying path 42. During the abutment of the sheet S, skew of the sheet S is corrected.

The registration roller pair 49 starts driving to feed the sheet S toward the transfer nip region so as to synchronize rotation of the registration roller pair 49 with movement of the sheet S, so that the toner image formed on the surface of the photoconductor 1 is transferred onto the sheet S in a transfer nip region. At this time, the first conveying roller pair 41 starts driving at the same time as the rotation of the registration roller pair 49 to resume conveyance of the sheet S that has been halted.

The apparatus body 50 of the image forming apparatus 1000 contains a bypass tray unit including a bypass tray 43, a bypass feed roller 44, a sheet separation pad 45. The sheet S that is loaded on the bypass tray 43 of the bypass tray unit is fed from the bypass tray 43 due to rotation of the bypass feed roller 44. After passing through the sheet separation nip region formed by the bypass feed roller 44 and the sheet separation pad 45, the sheet S enters an upstream region located upstream from the registration roller pair 49 in the sheet conveying path 42 in the sheet conveying direction. Thereafter, similarly to the sheet S discharged from the sheet tray 100, the sheet S is conveyed to the transfer nip region after passing through the registration roller pair 49.

Figure 2:
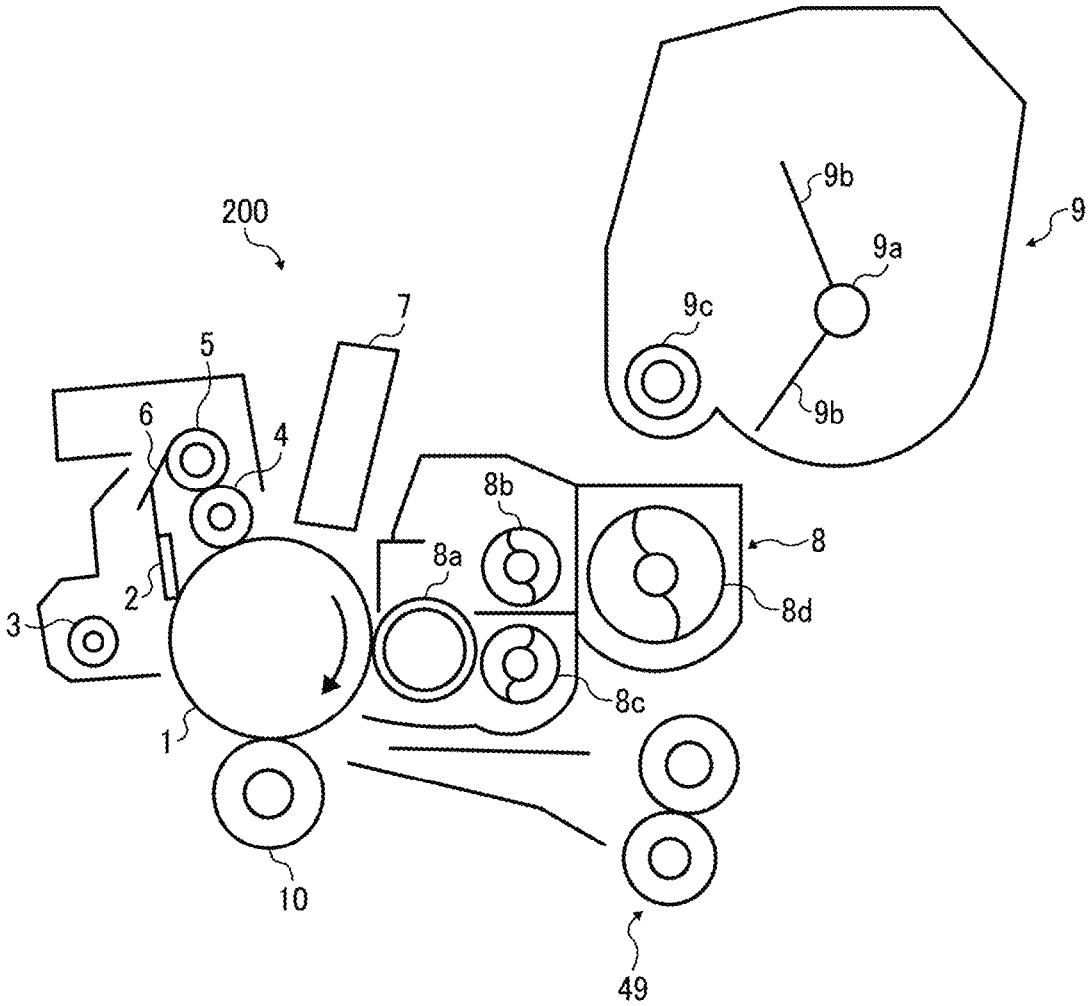
FIG. 2 is an enlarged view illustrating an image forming part including a photoconductor and image forming units disposed around the photoconductor included in the image forming apparatus of FIG. 1.

FIG. 2 is an enlarged view illustrating an image forming part 200 including the photoconductor 1 and image forming devices disposed around the photoconductor 1 included in the image forming apparatus 1000 of FIG. 1.

The photoconductor 1 is a drum-shaped photoconductor that rotates clockwise in FIG. 2. The image forming devices disposed around the photoconductor 1 are a toner collection screw 3, a cleaning blade 2, a charging roller 4, a latent image writing device 7, a developing device 8, a transfer roller 10, and the like.

The charging roller 4 includes a conductive rubber roller and forms a charging nip region by rotating while being in contact with the photoconductor 1. A charging bias that is outputted from a power source is applied to the charging roller 4. Thus, in the charging nip region, an electrical discharge is induced between the surface of the photoconductor 1 and a surface of the charging roller 4. As a result, the surface of the photoconductor 1 is uniformly charged.

The latent image writing device 7 includes an LED (light-emitting diode) array and performs light scanning with LED light over the surface of the photoconductor 1 that has been uniformly charged. On a ground surface of the photoconductor 1 that has been uniformly charged, the area having been subjected to the light irradiation through this light scanning attenuates the electric potential therein. This results in formation of an electrostatic latent image on the surface of the photoconductor 1.

As the photoconductor 1 rotates, the electrostatic latent image passes through a development region that is located facing the developing device 8. The developing device 8 includes a circulation conveying portion and a developing portion. The circulation conveying portion accommodates developer containing toner and magnetic carriers. The circulation conveying portion includes a first screw 8*b* for conveying the developer to be supplied to a developing roller 8*a*, a second screw 8*c* for conveying the developer in an independent space positioned beneath the first screw 8*b*. Further, the circulation conveying portion includes an inclined screw 8*d* for receiving the developer from the second screw 8*c* and supplying the developer to the first screw 8*b*. The developing roller 8*a*, the first screw 8*b*, and the second screw 8*c* are placed at attitudes parallel with each other. By contrast, the inclined screw 8*d* is placed at an attitude inclined with respect to the developing roller 8*a*, the first screw 8*b*, and the second screw 8*c*.

The first screw 8*b* conveys the developer from a distal side toward a proximal side in a direction perpendicular to the drawing sheet of FIG. 2 as the first screw 8*b* rotates. At this time, the first screw 8*b* supplies a portion of the developer to the developing roller 8*a* that is disposed opposite to the first screw 8*b*. The developer having been conveyed by the first screw 8*b* to the vicinity of a proximal end portion of the first screw 8*b* in the direction perpendicular to the drawing sheet of FIG. 2 is dropped onto the second screw 8*c*.

The second screw 8*c* receives used developer from the developing roller 8*a* and, at the same time, conveys the received developer from the distal side toward the proximal side in the direction perpendicular to the drawing sheet of FIG. 2 as the second screw 8*c* rotates. The developer conveyed by the second screw 8*c* to the vicinity of the end portion thereof that is close in the direction perpendicular to the drawing sheet of FIG. 2 is supplied to the inclined screw 8*d*. Further, along with rotation of the inclined screw 8*d*, the developer is conveyed from the proximal side toward the distal side in the direction perpendicular to the drawing sheet of FIG. 2. Thereafter, the developer is supplied to the first screw 8*b* in the vicinity of the distal end portion thereof in the direction perpendicular to the drawing sheet of FIG. 2.

The developing roller 8*a* includes a rotatable developing sleeve and a magnet roller. The rotatable developing sleeve is a tubular-shaped non-magnetic member. The magnet roller is fixed to the developing sleeve in such a way as not to rotate together with the developing sleeve. Further, the developing roller 8*a* takes up a portion of the developer that is conveyed by the first screw 8*b* onto the surface of the developing sleeve due to a magnetic force generated by the magnet roller. The developer that is carried on the surface of the developing sleeve passes through an opposite position facing a doctor blade. At this time, the thickness of a layer of the developer on the surface of the developing sleeve is regulated while the developer is rotated together with the surface of the development sleeve. Thereafter, the developing roller 8*a* moves while sliding on the surface of the photoconductor 1 in the developing area in which the developing roller 8*a* faces the photoconductor 1.

A development bias having the same polarity as the toner and an electric potential at the surface of the photoconductor 1 is applied to the developing sleeve. The absolute value of this development bias is greater than the absolute value of electric potential of the latent image and is smaller than the absolute value of the electric potential at the surface. Therefore, in the development area, a development potential acts between the developing sleeve and the electrostatic latent image formed on the photoconductor 1 in such a way as to electrostatically move the toner from the developing sleeve to the latent image. By contrast, a background potential acts between the development sleeve and the ground surface of the photoconductor 1 to electrostatically move the toner from the background surface to the developing sleeve. This causes the toner to selectively adhere to the electrostatic latent image formed on the photoconductor 1, so that the electrostatic latent image is developed in the development area.

The developer that has passed through the development area enters an opposite area in which the developing sleeve faces the second screw 8*c* as the developing sleeve rotates. In the opposite area, a repulsive magnetic field is formed by two magnetic poles having polarities different from each other out of multiple magnetic poles included in the magnet roller. The developer that has entered the opposite area is separated from the surface of the developing sleeve and is collected by the second screw 8*c* due to the effect of the repulsive magnetic field.

The developer that is conveyed by the inclined screw 8*d* contains the developer that has been collected from the developing roller 8*a*, and this developer is contributed to development in the development area, so that the toner concentration is lowered. The developing device 8 includes a toner concentration sensor for detecting the toner concentration of the developer to be conveyed by the inclined screw 8*d*.

Based on detection results obtained by the toner concentration sensor, a controller 300 outputs a replenishment operation signal for replenishing the toner to the developer that is conveyed by the inclined screw 8*d*, as required.

A toner cartridge 9 is disposed above the developing device 8 and includes a rotary shaft 9*a*, toner stirring members 9*b*, and a toner replenishment member 9*c*, as illustrated in FIG. 2. The toner cartridge 9 stirs and agitates the toner contained therein with the toner stirring members 9*b* fixed to the rotary shaft 9*a*. Further, the toner replenishment member 9*c* is driven to rotate according to the replenishment operation signal outputted from the controller 300. With this operation, the toner in an amount corresponding to a rotation amount of the toner replenishment member 9*c* is replenished to the inclined screw 8*d* of the developing device 8.

The toner image formed on the photoconductor 1 as a result of the development enters the transfer nip region where the photoconductor 1 and the transfer roller 10 that functions as a transfer device contact each other as the photoconductor 1 rotates. A charging bias having the opposite polarity to the latent image electric potential of the photoconductor 1 is applied to the transfer roller 10. Accordingly, an electric field is formed in the transfer nip region.

As described above, the registration roller pair 49 conveys the sheet S toward the transfer nip region in synchronization with a timing at which the toner image formed on the photoconductor 1 is overlaid onto the sheet S in the transfer nip region. The toner image formed on the photoconductor 1 is transferred onto the sheet S that is closely contacted to the toner image in the transfer nip region due to the actions of the electric field in the transfer nip region and the nip pressure.

Residual toner that is not transferred onto the sheet S remains on the surface of the photoconductor 1 after having passed through the transfer nip region. The residual toner is scraped off from the surface of the photoconductor 1 by the cleaning blade 2 that is in contact with the photoconductor 1 and, thereafter, is transmitted toward an outside of a unit casing by the collection screw 3. The residual toner that is removed from the unit casing is transported to a waste toner bottle by a conveying device.

The surface of the photoconductor 1 that is cleaned by the cleaning blade 2 is electrically discharged by an electric discharging device. Thereafter, the surface of the photoconductor 1 is uniformly charged again by the charging roller 4. Foreign materials such as toner additive agents and the toner that has not been removed by the cleaning blade 2 adhere to the charging roller 4 that is in contact with the surface of the photoconductor 1. These foreign materials are shifted to a cleaning roller 5 that is in contact with the charging roller 4. Thereafter, the foreign materials are scraped off from the surface of the cleaning roller 5 by a scraper 6 that is in contact with the cleaning roller 5. The foreign materials scraped off from the surface of the cleaning roller 5 falls onto the toner collection screw 3.

In FIG. 1, the sheet S that has passed through the transfer nip region formed by the photoconductor 1 and the transfer roller 10 contacting each other is conveyed to a fixing device 30. The fixing device 30 includes a fixing roller 30*a* and a pressure roller 30*b*. The fixing roller 30*a* includes a heat generating source such as a halogen lamp. The pressure roller 30*b* is pressed against the fixing roller 30*a*. The fixing roller 30*a* and the pressure roller 30*b* contacting each other form a fixing nip region. The toner image is fixed to the surface of the sheet S that is held in the fixing nip region due to application of heat and pressure. Thereafter, the sheet S that has passed through the fixing device 30 passes through a sheet discharging path 31. Then, the sheet S is held in a sheet discharging nip region of a sheet discharging roller pair 32.

The image forming apparatus 1000 according to this example can switch or change modes between a single side printing mode and a duplex printing mode. The image forming apparatus 1000 according to this example can switch or change modes between a single side printing mode and a duplex printing mode. In a case in which the single side printing mode is selected or in a case in which the duplex printing mode is selected when images have already been formed on both sides of the sheet S, the sheet discharging roller pair 32 is continuously driven to rotate in a forward direction. By so doing, the sheet S in the sheet discharging path 31 is discharged to an outside of the image forming apparatus 1000. The discharged sheet S is stacked in a stack portion provided on the upper surface of the apparatus body 50.

By contrast, when an image is formed on one side (i.e., a front face) of the sheet S in the duplex printing mode, the sheet discharging roller pair 32 is driven to reversely rotate at the timing when the end portion (e.g., the leading end) of the sheet S enters the sheet discharging nip region formed by the pair of the sheet discharging roller pair 32. At this time, a separating claw 47 that is disposed in the vicinity of an terminal end of the sheet discharging path 31 is activated to close the sheet discharging path 31 and open an entrance of a sheet reverse reentry path 48. The sheet S starts moving in a reverse direction to the sheet conveying direction as the sheet discharging roller pair 32 rotates reversely. Then, the sheet S is conveyed into the sheet reverse reentry path 48. Further, the sheet S is conveyed while being reversed upside down through the sheet reverse reentry path 48, and then is conveyed to the registration nip region of the registration roller pair 49 again. Then, after the toner image is transferred onto the other side (e.g., a reverse side) in the transfer nip region, the sheet S passes through the fixing device 30, the sheet discharging path 31, and the sheet discharging roller pair 32 to be discharged to the outside of the image forming apparatus 1000.

Now, a description is given of a sheet tray 970 provided to an image forming apparatus according to comparative examples, with FIGS. 3 through 7.

Figure 3:
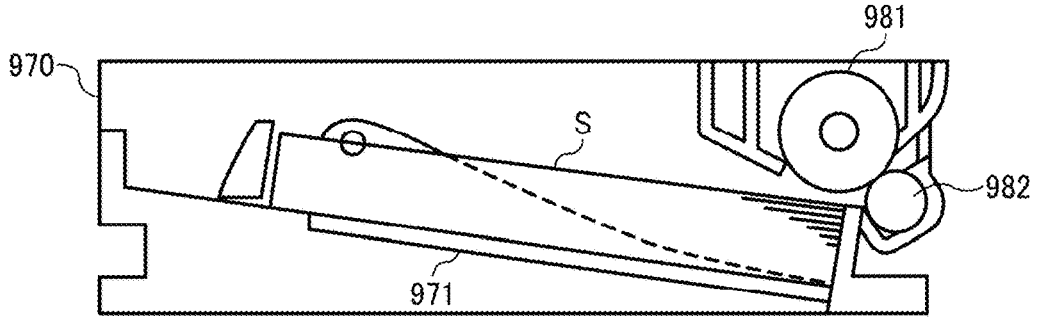
FIG. 3 is a diagram illustrating a comparative sheet tray of a known image forming apparatus.

FIG. 3 is a diagram illustrating a comparative sheet tray of a known image forming apparatus.

In FIG. 3, a comparative sheet tray 970 accommodates multiple sheets S as a sheet bundle therein. The sheet tray 970 is attached to and detached from an apparatus body of the image forming apparatus in a direction perpendicular to the drawing sheet of FIG. 3.

A sheet feed roller 981 is disposed in the vicinity of the sheet tray 970 and supported by the apparatus body.

The leading end of the sheet bundle contained in the sheet tray 970 is biased by a movable bottom plate 971 of the sheet tray 970 to an upward direction, so that the leading end of the sheet bundle contacts the sheet feed roller 981 to form a pressed region.

In the vicinity of the pressed region, the sheet feed roller 981 and a sheet separating roller 982 are in contact with each other to form a sheet separation nip region.

As the sheet feed roller 981 rotates, an uppermost sheet Sa placed on top of the sheet bundle is fed from the sheet tray 970 toward the sheet separation nip region. At this time, it is likely that not only the uppermost sheet Sa but also a subsequent sheet Sb immediately below the uppermost sheet Sa are fed in layers from the sheet tray 970. This sheet feeding operation is called as "multifeed". When multiple sheets are held in the sheet separation nip region due to the misfeed, the uppermost sheet Sa that is in direct contact with the sheet feed roller 981 is fed in a sheet feeding direction along with movement of a surface of the sheet feed roller 981. By contrast, the other sheets such as the subsequent sheet Sb is conveyed by the sheet separating roller 982 back to the sheet tray 970 along with movement of a surface thereof in an opposite direction to the sheet feed roller 981 in the sheet separation nip region. According to this conveyance back to the sheet tray 970, even when multifeed occurs, a single sheet, i.e., the uppermost sheet Sa, which direct contacts the sheet feed roller 981 is separated from the other sheets in the sheet bundle. Thereafter, the uppermost sheet Sa is conveyed toward an image forming part of the image forming apparatus.

Generally, each sheet of a sheet bundle contained in a sheet tray is conveyed by a pickup roller that is provided different from a sheet feed roller and a sheet separating roller. However, the sheet tray 970 of the comparative image forming apparatus illustrated in FIG. 3 does not include a pickup roller and causes the sheet feed roller 981 to play the role of the pickup roller. This structure, which is called as a pickup less structure, can achieve a reduction in cost by not providing any pickup roller.

Figure 4:
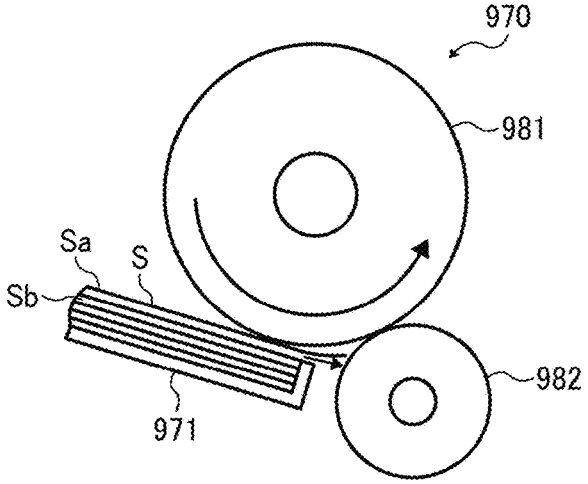
FIG. 4 is a diagram illustrating a sheet fed from the comparative sheet tray of FIG. 3 at the beginning of a sheet feeding operation.

However, when a sheet S as a recording medium having a small rigidity such as a thin paper is used, the sheet tray of the pickup less structure can easily generate crease on the sheet in the sheet separation nip region. Specifically, as illustrated in FIG. 4, a circumferential surface of the sheet feed roller 981 contacts the leading end of the sheet bundle and the sheet separating roller 982 in the sheet tray 970 employing the pickup less structure. Therefore, the leading end of the sheet bundle is located at a position significantly close to the sheet separation nip region. After passing the pressed region formed between the movable bottom plate 971 and the sheet feed roller 981, the leading end of the sheet S fed from the sheet tray 970 along with rotation of the sheet feed roller 981 is conveyed while being slightly separated from a curved surface of the sheet feed roller 981 without closely contacting thereto. Due to this state, the sheet S does not enter the sheet separation nip region straightly but the leading end of the sheet S substantially constantly abuts against a surface of the sheet separating roller 982 before the sheet separation nip region.

Figure 5:
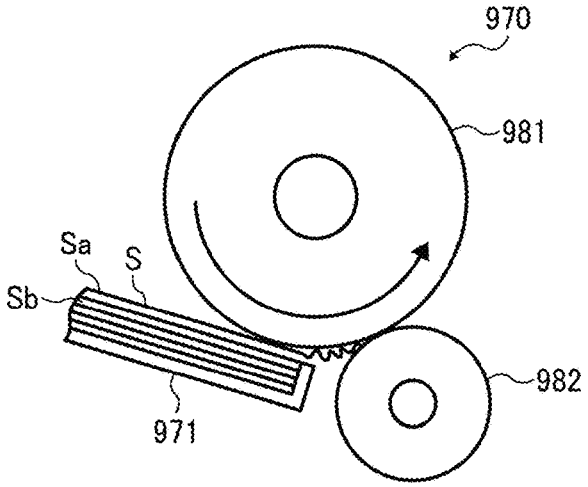
FIG. 5 is a diagram illustrating waves generated on a sheet having a small rigidity accommodated in the sheet tray of FIG. 3 at a sheet separation nip region.

When the leading end of the sheet having a small rigidity abuts against the circumferential surface of the sheet separating roller 982, vertical waves are formed on the sheet S in a direction perpendicular to a sheet conveying direction, as illustrated in FIG. 5. When the waves are sandwiched between the sheet feed roller 981 and the sheet separating roller 982 in the sheet separation nip region, creases are formed on the sheet S.

It is to be noted that, even if a guide is provided to guide the leading end of the sheet S fed form the sheet tray 970 toward the sheet separation nip region, creases are formed on the sheet S having a small rigidity because the leading end of the sheet S having a small rigidity abuts against the guide to form waves.

Figure 6:
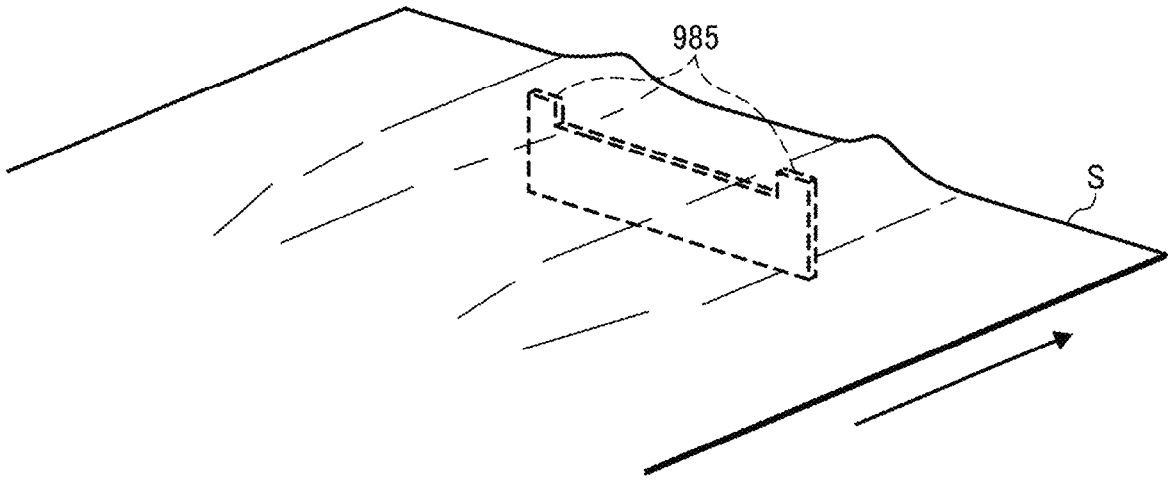
FIG. 6 is a perspective view illustrating bends and wrinkles produced by the bend applying members on a sheet accommodated in the sheet tray of FIG. 3.

FIG. 6 is a perspective view illustrating bends and wrinkles produced by bend applying members 985 on the sheet S accommodated in the sheet tray 970 of FIG. 3.

As illustrated in FIG. 6, each of the bend applying members 985 bends the sheet S before the sheet separation nip region. The bend applying members 985 are disposed to contact the sheet S before the sheet separation nip region from below in a direction of gravitation. The contact of each of the bend applying members 985 to part of the sheet S from below in the direction of gravitation bends the sheet S having a small rigidity partially, resulting in generation of wrinkles in the sheet conveying direction as indicated by arrow in FIG. 6. Forming such a bent part on the sheet S makes it difficult to generate another bent part in a direction perpendicular to the bent part, and therefore prevents forming waves on the sheet S as illustrated in FIG. 5. Accordingly, occurrence of creases of the sheet S having a small rigidity in the sheet separation nip region.

It is to be noted that both the sheet feed roller 981 and the sheet separating roller 982 illustrated in FIG. 5 are short rollers contacting a region formed between two wrinkles formed on the sheet S by the two bend applying members 985 as illustrated in FIG. 6. Therefore, these two winkles are not sandwiched by the sheet feed roller 981 and the sheet separating roller 982 in the sheet separation nip region to generate crease of the sheet S.

Figure 7:
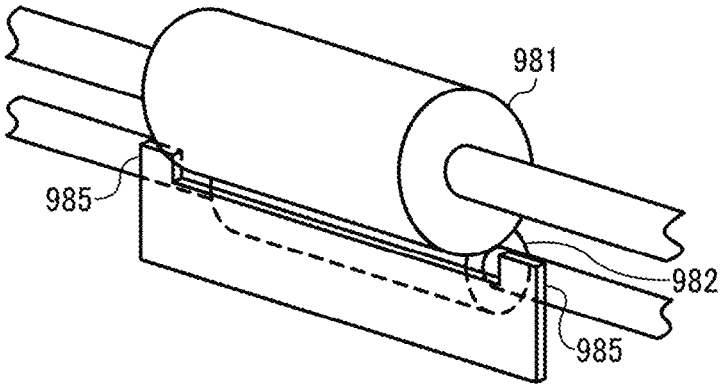
FIG. 7 is a perspective view illustrating a sheet feed roller, a sheet separating roller, and the bend applying members of an image forming apparatus.

It has been found that, when a sheet S having a large rigidity such as a thick paper is used in the image forming apparatus having the above-described configuration, conveyance of the sheet S fed from the sheet tray 970 illustrated in FIGS. 3 through 5 is easily delayed or stopped in or in the vicinity of the sheet separation nip region. This phenomenon is called as a misfeed. The misfeed has occurred with the sheet tray 970 due to the following reasons. Specifically, as illustrated in FIG. 7, one of the two bend applying members 985 is located at a position shifted to one side of respective roller parts of the sheet feed roller 981 and the sheet separating roller 982 in the rotation axis direction of the sheet feed roller 981 and the sheet separating roller 982. The other of the two bend applying members 985 is located at a position shifted to the other side of the roller parts of the sheet feed roller 981 and the sheet separating roller 982 in the rotation axis direction. In order to generate relatively large wrinkles as illustrated in FIG. 6, respective leading ends of the bend applying members 985 project significantly upward and higher than a travel course of the sheet S indicated by arrow in FIG. 5.

By lifting both ends in a width direction of the sheet S (i.e., the direction perpendicular to the sheet conveying direction) significantly before the sheet S enters the sheet separation nip region by using the two bend applying members 985, the center part of the sheet S in the width direction thereof is pressed hard to a region immediately before the sheet separation nip region on the circumferential surface of the sheet feed roller 981. According to this configuration, a large conveyance resistance is applied to the sheet S to cause the sheet S to slip on the circumferential surface of the sheet feed roller 981. Accordingly, the sheet S cannot be conveyed in the sheet conveying direction, resulting in misfeed.

Next, a description is given of the detailed configuration of the image forming apparatus 1000.

Figure 8:
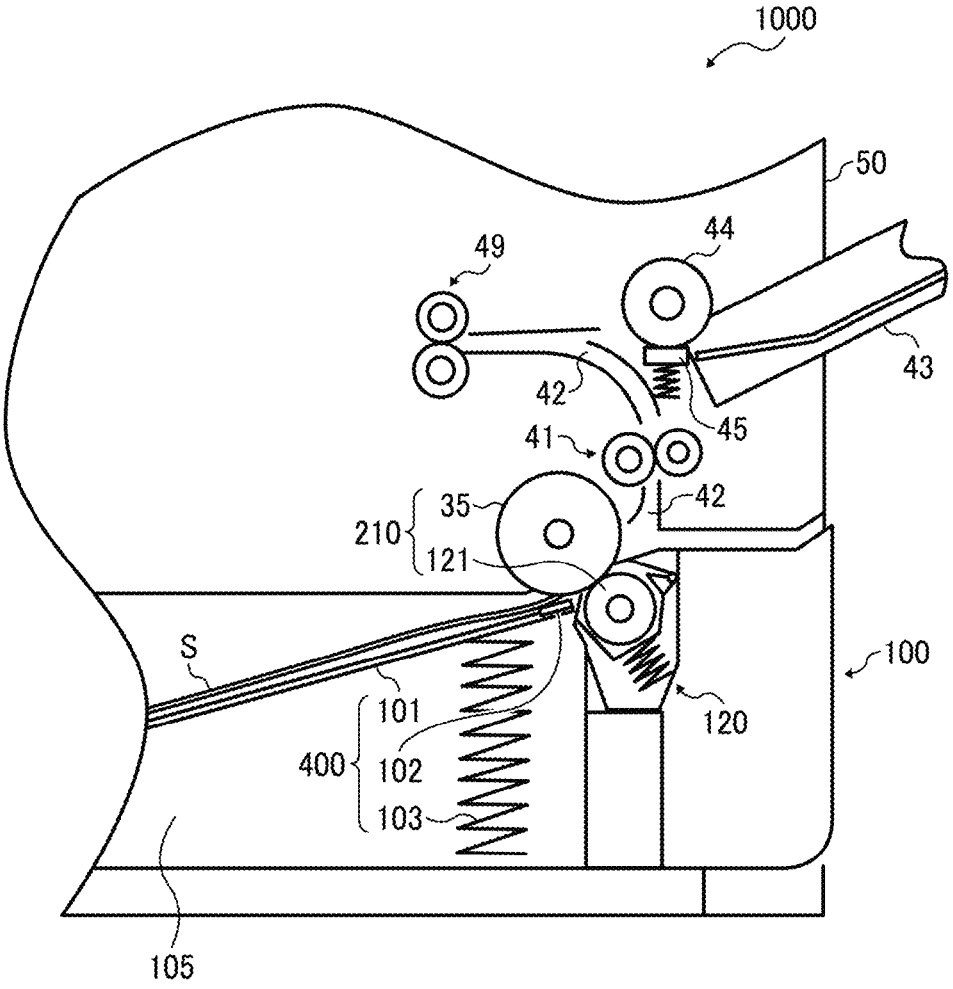
FIG. 8 is a partial enlarged view illustrating a lower part of the image forming apparatus of FIG. 1.

FIG. 8 is a partial enlarged view illustrating a lower part of the image forming apparatus 1000 of FIG. 1.

As illustrated in FIG. 8, the sheet tray 100 accommodates the sheet bundle of the multiple sheets S loaded on a movable bottom plate 101. The movable bottom plate 101 is biased toward the sheet feed roller 35 by a bottom plate spring 103. A bottom plate pad 102 that is an elastic member is fixed at the leading end portion of the movable bottom plate 101. The leading end portion of the sheet bundle is pressed toward the sheet feed roller 35 by the force exerted by the bottom plate spring 103 in a state in which the leading end portion of the sheet bundle is sandwiched between the bottom plate pad 102 and the sheet feed roller 35.

Figure 16:
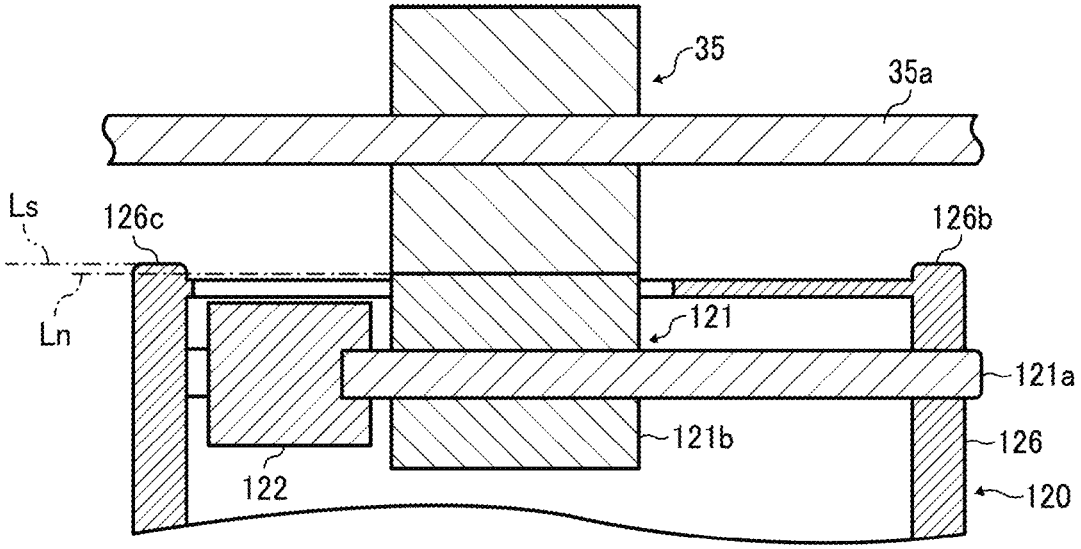
FIG. 16 is a vertical cross sectional view illustrating the sheet feeding roller and the separation roller unit of FIG. 13.

The sheet feed roller 35 has a rotary shaft 35*a* (FIG. 16).

As the sheet feed roller 35 rotates, an uppermost sheet S placed on top of the sheet bundle is fed from the movable bottom plate 101. Then, the uppermost sheet S enters the sheet separation nip region formed by contact of the sheet feed roller 35 and a sheet separating roller 121 included in a separation roller unit 120. The sheet feed roller 35 that functions as a sheet feeding body and the sheet separating roller 121 that functions as a sheet separating body form a sheet separating part 210 that functions as a sheet separating feeder.

In the image forming apparatus 1000, as described above, the sheets S are fed from the sheet tray 100 as the sheet feed roller 35 is driven in a state in which the sheet S is pressed against the sheet feed roller 35 by a pressing device 400 including the movable bottom plate 101, the bottom plate pad 102, and the bottom plate spring 103. This configuration can achieve cost reduction by not providing a pickup roller for the sheet tray 100. That is, the image forming apparatus 1000 reduces the cost by employing a pickup-less structure.

Generally, a rotation driving force is applied to the sheet separating roller 121 for moving the surface of the sheet separating roller 121 in a direction opposite to the direction of rotation of the sheet feed roller 35, as required. However, in the image forming apparatus 1000 according to the present example, such a rotation driving force is not applied to the sheet separating roller 121. The sheet separating roller 121 rotates by following rotation of the sheet feed roller 35 and movement of the sheets S in the sheet separation nip region.

The sheet separating roller 121 has a rotary shaft 121*a* (see FIG. 16) and a cylindrical roller part 121*b* (FIG. 16). One end of the rotary shaft 121*a* of the sheet separating roller 121 is rotatably supported by a torque limiter 122 (see FIG. 15). When the sheet S is not in the sheet separation nip region, the sheet separating roller 121 contacts the sheet feed roller 35 directly. As the sheet feed roller 35 rotates in this state, a relatively large driving force is applied from the sheet feed roller 35 to the sheet separating roller 121. According to this configuration and operation, a torque of rotation of the sheet separating roller 121 exceeds a given threshold of the torque of rotation thereof, so that the torque limiter 122 causes the sheet separating roller 121 to rotate. That is, when the sheet S is not entered in the sheet separation nip region, the sheet separating roller 121 rotates with the sheet feed roller 35.

Further, when a single sheet S enters the sheet separation nip region, there are no sheets other than the single sheet S between the sheet separating roller 121 and the sheet feed roller 35. In this state, if the sheet feed roller 35 rotates, the sheet feed roller 35 exerts a strong conveying force on the sheet S, and therefore the sheet S moves in the sheet feeding direction. At the same time, the sheet feed roller 35 exerts a relatively strong driving force on the sheet separating roller 121 via the sheet S interposed therebetween. Consequently, the torque for rotating the sheet separating roller 121 with the sheet feed roller 35 exceeds a predetermined threshold value, so that the torque limiter permits the sheet separating roller 121 to rotate with the sheet feed roller 35. Specifically, when the single sheet S exists in the sheet separation nip region, the sheet separating roller 121 rotates with the sheet feed roller 35.

By contrast, it is assumed that two or more sheets S enter the sheet separation nip region in a form of layers due to multi feed. In this case, the sheet feed roller 35 exerts a relatively strong conveying force on the uppermost sheet S that is in direct contact with the sheet feed roller 35 in the sheet separation nip region, and therefore the uppermost sheet S is conveyed in the sheet feeding direction.

Further, the remaining sheets S other than the uppermost sheet S are pressed in the sheet separation nip region, and therefore are subjected to a conveyance resistance. This conveyance resistance exceeds a frictional resistance between the uppermost sheet S and a subsequent sheet S, that is, a second sheet S. Accordingly, a slip is induced between the uppermost sheet S and the subsequent sheet S. Due to this slip, the torque for causing the sheet separating roller 121 to rotate with the sheet feed roller 35 comes to be equal to or smaller than the predetermined threshold value, so that the torque limiter stops the sheet separating roller 121 from rotating with the sheet feed roller 35. This operation further increases the conveyance resistance exerted on the second and other subsequent sheets S. As a result, movement of the second and other subsequent sheets S is stopped. Thus, the sheet separating roller 121 exerts the conveyance resistance on the multiple sheets S and separates the uppermost sheet S from the other sheets S of the sheet bundle.

The image forming apparatus 1000 having this configuration separates the sheets S in the sheet separation nip region without exerting a rotation driving force from a motor on the sheet separating roller 121. With this separation of the sheet S in the sheet separation nip region, a driving transmission device for transmitting driving to the sheet separating roller 121 is eliminated, thereby enabling cost reduction.

Figure 9:
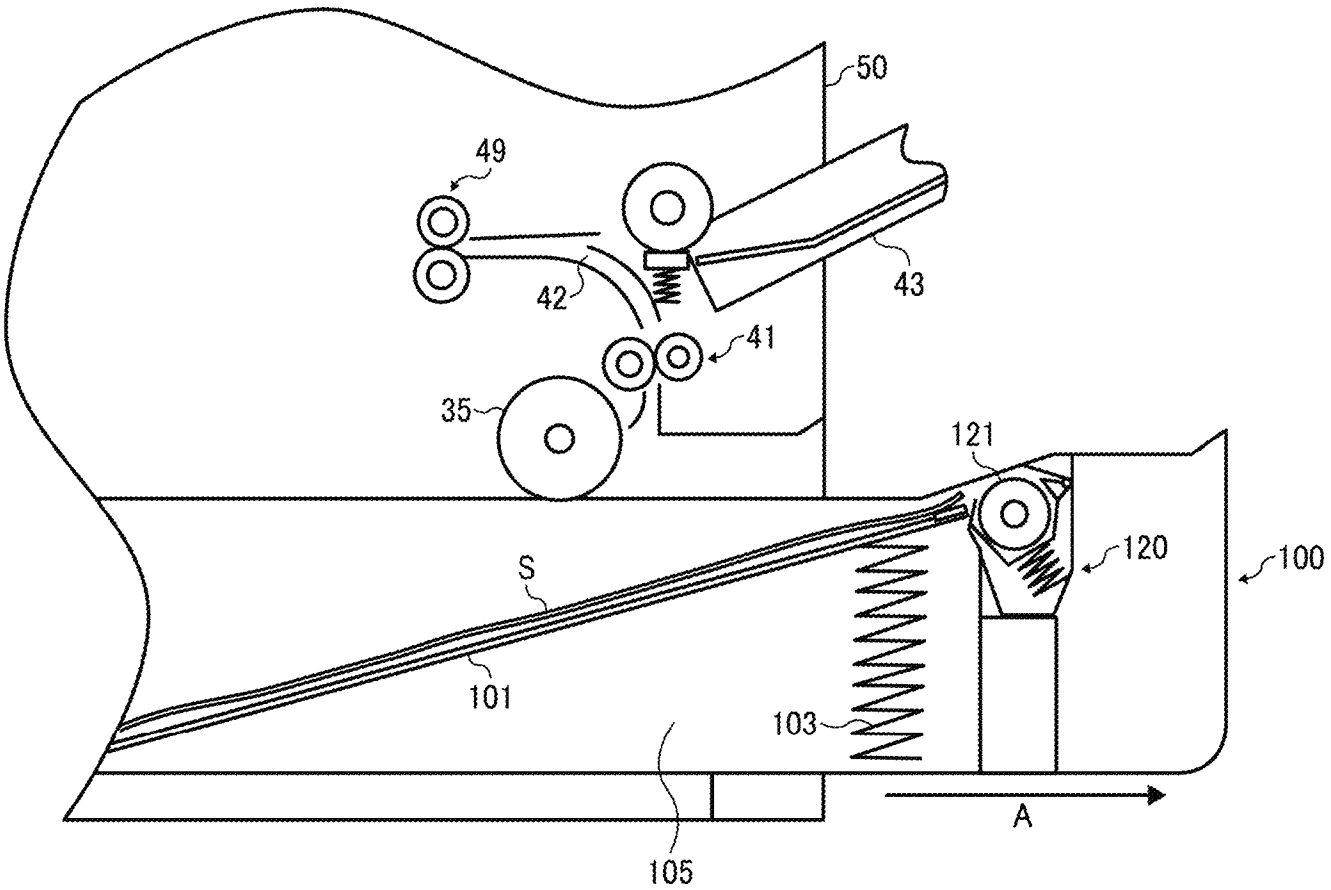
FIG. 9 is a partial enlarged view illustrating a sheet tray that is being pulled out from an apparatus body of the image forming apparatus body of FIG. 1.

FIG. 9 is a partial enlarged view illustrating the sheet tray 100 that is being pulled out from the apparatus body 50 of the image forming apparatus 1000.

As illustrated in FIG. 9, the image forming apparatus 1000 has the configuration in which the sheet separating roller 121 is supported by the sheet tray 100 and is disposed detachably attachable to the apparatus body 50 together with the sheet tray 100. With this configuration, the sheet tray 100 can be detachably attached to the apparatus body 50 by sliding not in an axial direction of rotation of a roller such as the sheet feed roller 35 and the sheet separating roller 121 but in a left-to-right direction in FIG. 9. Since the sheet separating roller 121 moves together with the sheet tray 100, the sheet separating roller 121 does not obstruct sliding and moving of the sheet tray 100 in a direction indicated by arrow A along the left-to-right direction in FIG. 9. Hereinafter, the axial direction of rotation of a roller such as the sheet feed roller 35 and the sheet separating roller 121 is referred to as a "roller axis direction".

If a paper jam occurs in a state in which the sheet S is being held in the sheet separation nip region, a user slides and moves the sheet tray 100 in the direction A in FIG. 9 to pull out the jammed sheet S from the apparatus body 50. Then, the sheet separating roller 121 is taken out therefrom together with the sheet tray 100, and therefore the sheet separation nip region is eliminated. However, the jammed sheet S is held in a sheet conveyance nip region formed by the first conveying roller pair 41, and, therefore remains in the apparatus body 50.

Since the sheet tray 100 is pulled out from apparatus body 50, space is generated within apparatus body 50. The space is largely open in the direction A in FIG. 9, which is a sheet tray detaching direction. The user can easily and visually recognize the jammed sheet toward the surface thereof through this opening.

Further, the user can pull out the jammed sheet from the sheet conveyance nip region formed by the first conveying roller pair 41 while grasping the opposite end portions of the jammed sheet in the roller axis direction with his/her both hands inserted through the opening. At this time, respective pulling forces are exerted on the opposite end portions of the jammed sheet. By so doing, concentrations of the pulling forces are restrained and occurrence of tears of the jammed sheet can be substantially avoided in comparison with cases where the jammed sheet is grasped at one end portion thereof.

Accordingly, the image forming apparatus 1000 can restrain tears of jammed sheets during eliminating paper jams.

It is to be noted that the sheet tray pull-out direction of the image forming apparatus 1000 from the apparatus body 50 (i.e., the direction A in FIG. 9) is a direction in which the sheet tray 100 is moved from the side close to a sheet containing unit 105 toward the side close to the separation roller unit 120, as illustrated in FIG. 9.

Figure 10:
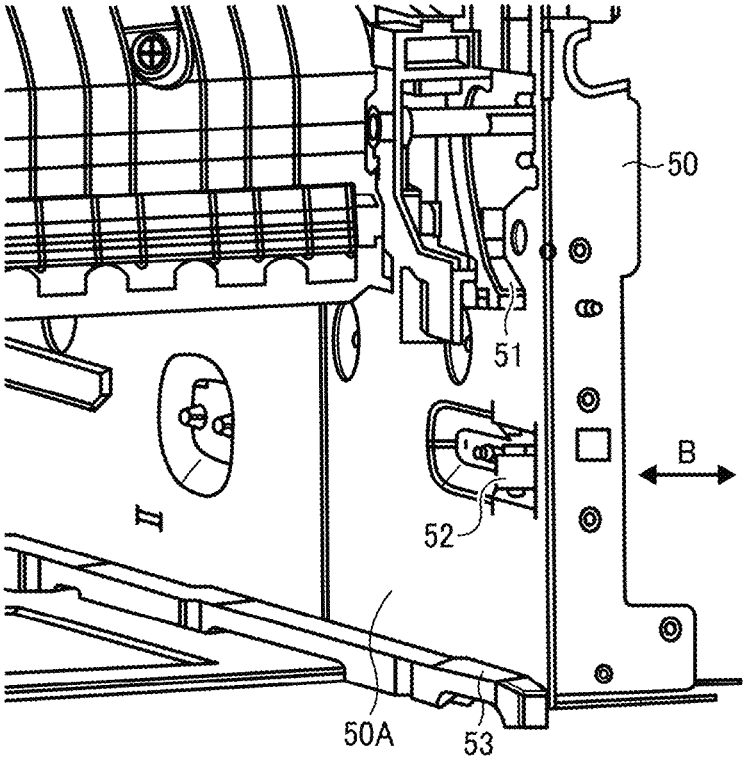
FIG. 10 is a partial perspective view illustrating the apparatus body with space therein due to withdrawal of the sheet tray of FIG. 9.

FIG. 10 is a partial perspective view illustrating the apparatus body 50 with space therein due to withdrawal of the sheet tray 100. A direction indicated by arrow B is the roller axis direction of the sheet feed roller 35. FIG. 10 illustrates one end portion of the sheet feed roller 35 in the roller axis direction in the apparatus body 50.

A rail 53 is disposed at one end of the identical roller axis direction of the sheet feed roller 35 on a bottom part of the apparatus body 50. The rail 53 extends in a sheet tray detaching/attaching direction in which the sheet tray 100 is detached and attached with respect to the apparatus body 50 of the image forming apparatus 1000. It is to be noted that another rail that is identical to the rail 53 is also disposed at the other end of the identical roller axis direction of the sheet feed roller 35 on the bottom part of the apparatus body 50.

The sheet tray 100 slides in a direction in which the rails 53 extend while being placed on the rails 53. By so doing, the sheet tray 100 can be detached and attached with respect to the apparatus body 50. Further, by placing the sheet tray 100 on the rail 53 and the rail disposed at the other end of the sheet feed roller 35 on the bottom part of the apparatus body 50, the height of the sheet tray 100 in the apparatus body 50 can be positioned.

In FIG. 10, a member that extends vertically in the apparatus body 50 is a right side plate 50A of the apparatus body 50. Though not illustrated in FIG. 10, a left side plate of the apparatus body 50 is also disposed on the opposite end to the right side plate 50A in the identical roller axis direction. A positioning stopper 51 is mounted on an inner wall of the right side plate 50A. The positioning stopper 51 positions the sheet tray 100 in the apparatus body 50 in the sheet tray detaching/attaching direction. An identical positioning stopper is mounted on an inner wall of the left side plate of the apparatus body 50. The sheet tray 100 includes a contact part 108 (refer to FIG. 11). When the sheet tray 100 is placed on the rails 53 and inserted into the apparatus body 50, the sheet tray 100 abuts the contact part 108 against the positioning stopper 51. By so doing, the sheet tray 100 is positioned in the sheet tray detaching/attaching direction.

When the contact part 108 of the sheet tray 100 is simply abutted against the positioning stopper 51, if any impact or force is applied to the apparatus body 50, the sheet tray 100 is likely to be pushed in a tray removing direction.

To address the inconvenience, an engaging member 52 is disposed on an inner wall of a right side plate of the apparatus body 50 to be movable in the identical roller axis direction (as indicated by arrow B in FIG. 10). The engaging member 52 is biased by a spring, so that the engaging member 52 is restricted at a position projecting from the inner wall of the right side plate of the apparatus body 50 toward an inside of the apparatus body 50. As illustrated in FIG. 10, the engaging member 52 has a tapered portion.

Even though FIG. 10 illustrates a single engaging member 52 thereon, another engaging member 52 is disposed on an inner wall of a left side plate of the apparatus body 50 that is identical to the engaging member 52 on the inner wall of the right side plate thereof.

Figure 11:
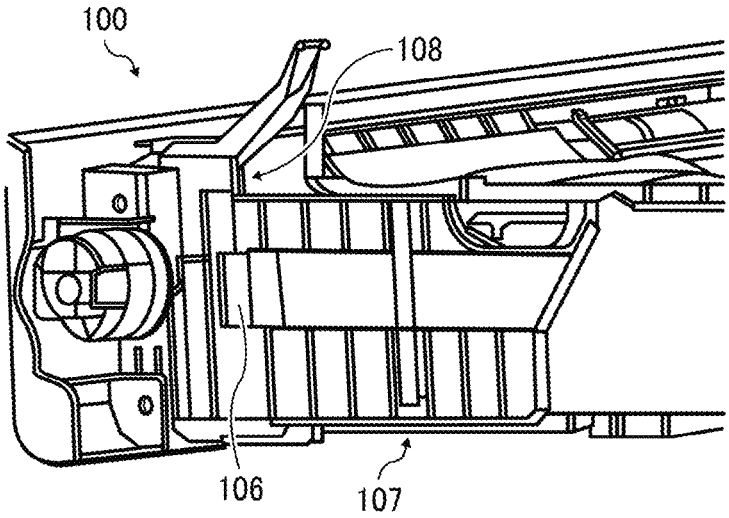
FIG. 11 is a partial perspective view illustrating the sheet tray viewed from a rear side thereof.

FIG. 11 is a perspective view illustrating a part of the sheet tray 100 viewed from a rear side thereof.

A tray fall prevention projection 106 is provided on an outer face of a right side plate of the sheet tray 100. A positioning part 107 is provided on an outer face of a bottom wall of the sheet tray 100. By putting the positioning part 107 on the rail 53 provided on the lower part of the apparatus body 50 illustrated in FIG. 10, the sheet tray 100 is positioned in the vertical direction.

As the sheet tray 100 is inserted into the inside of the apparatus body 50 on the rails 53 toward the rear side of the image forming apparatus 1000, the tray fall prevention projection 106 of the sheet tray 100 slides on the tapered portion of the engaging member 52 of the apparatus body 50. Along with sliding of the sheet tray 100, the engaging member 52 is pressed toward the outside of the side plate, and therefore a projection amount of the tray fall prevention projection 106 from the inner face of the side plate is reduced.

Immediately before the sheet tray 100 abuts the contact part 108 against the positioning stopper 51 of the apparatus body 50 to be positioned, the tray fall prevention projection 106 of the sheet tray 100 separates from the engaging member 52 of the apparatus body 50. Then, the engaging member 52 that has reduced an amount of projection from the inner wall of the side plate (e.g., the right side plate 50A) projects instantly to a position illustrated in FIG. 10. By causing a projecting part of the engaging member 52 to contact with a back surface of the tray fall prevention projection 106, the sheet tray 100 is prevented from moving in the sheet tray detaching direction, that is, is restrained to a regular position. As a result, even if a sudden and unexpected impact is applied to the apparatus body 50, the sheet tray 100 can be correctly positioned and restrained in the sheet tray detaching/attaching direction.

It is to be noted that the engaging member 52 further has a taper having a sharp angle on a rear side thereof in FIG. 10.

Due to the tray fall prevention projection 106 of the sheet tray 100, a force such as an impact cannot pull down the engaging member 52. However, when the user pulls out the sheet tray 100 from the apparatus body 50 with a force greater than the impact force, the tray fall prevention projection 106 of the sheet tray 100 pushes down the engaging member 52 while sliding with a great force on the taper formed on the rear side of the engaging member 52. Consequently, the user can pull out the sheet tray 100 from the apparatus body 50.

As described above, by performing vertical positioning and horizontal positioning of insertion and removal of the sheet tray 100, the sheet separating roller 121 that is supported by the sheet tray 100 is positioned in the apparatus body 50 precisely.

It is to be noted that, in order to position the sheet tray 100 in a vertical direction more precisely, a positioning stopper such as the positioning stopper 51 on each of two side plates (i.e., the right side plate 50A and the left side plate) of the apparatus body 50 includes a rail part and a fine projection that slightly projects from a surface of the rail part. A fine positioning part provided to the sheet tray 100 runs aground to the fine projection. At the same time, a contact part (e.g., the contact part 108) of the sheet tray 100 is caused to abut against a pressed part of the positioning stopper 51.

Figure 12:
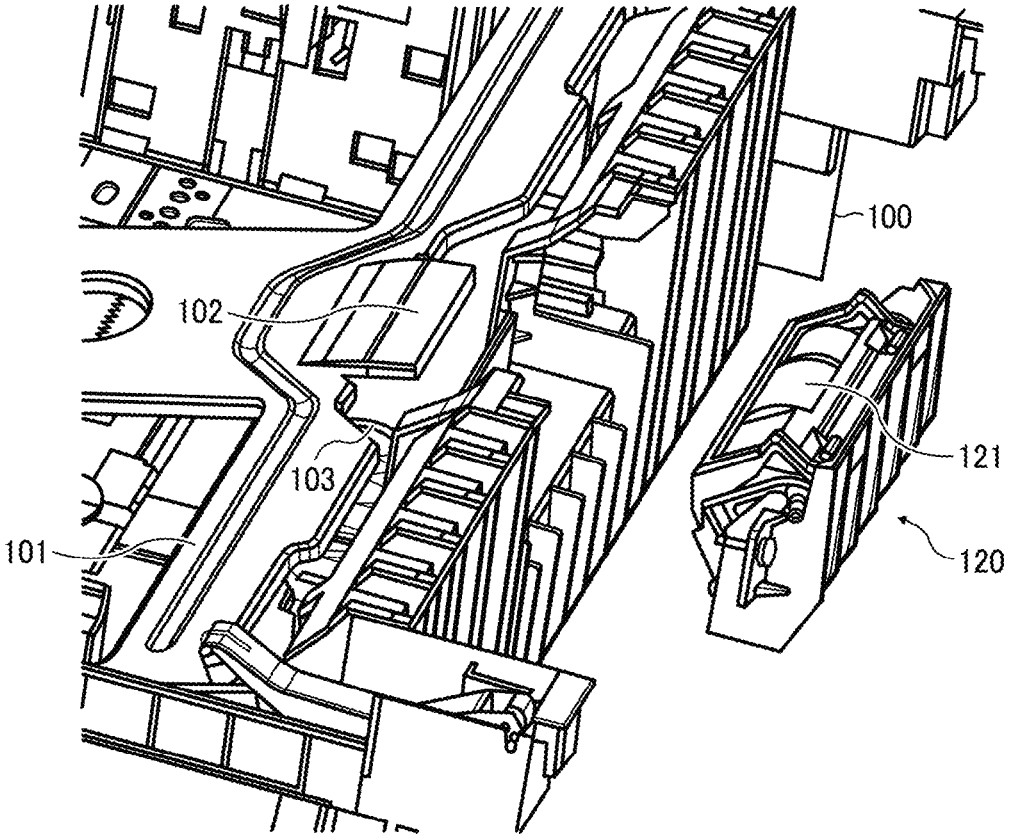
FIG. 12 is a partial perspective view illustrating the sheet tray viewed from a front side thereof.

FIG. 12 is a partial perspective view illustrating the sheet tray 100, viewed from a front side thereof. In FIG. 12, a front cover, which is a cover provided with a pulling-out handle, in the sheet tray 100 is not illustrated, for convenience.

As illustrated in FIG. 12, the sheet separating roller 121 that functions as a sheet separating body is structured to be included in the separation roller unit 120 together with in cooperation with other several components as described below. The separation roller unit 120 is integrally attached and detached with respect to a receiving portion in the sheet tray 100. Thus, by making the sheet separating roller 121 into a unit, components can be standardized with other types of image forming apparatuses. Accordingly, a cost reduction can be achieved. Specifically, sheet trays in other types of image forming apparatuses having different specifications from the image forming apparatus 1000 according to this example are also adapted to have the same configuration as the sheet tray 100 in the image forming apparatus 1000. However, such sheet trays in other types of image forming apparatuses are adapted to accommodate different numbers of sheets S from the sheet tray 100 in the image forming apparatus 1000. Therefore, the sheet trays in image forming apparatuses of different types have different thicknesses thereof. Even such sheet trays having different specifications as described above are adapted to include the separation roller unit 120 having completely the identical specifications to be attached and detached. Accordingly, standardization to use common components is achieved.

Figure 13:
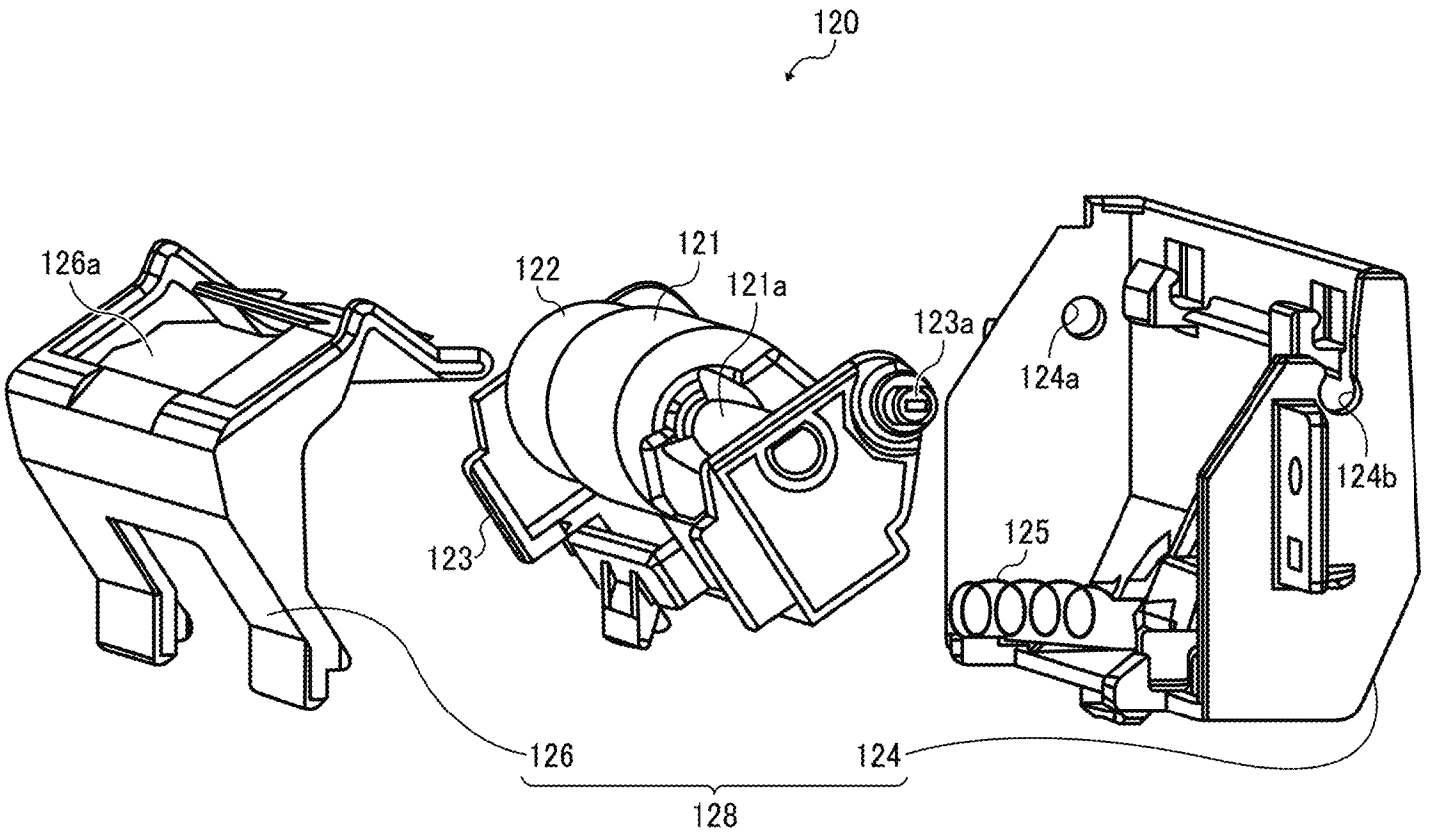
FIG. 13 is an exploded perspective view illustrating a separation roller unit included in the sheet tray.

FIG. 13 is an exploded perspective view illustrating the separation roller unit 120.

As illustrated in FIG. 13, the separation roller unit 120 includes the sheet separating roller 121, the torque limiter 122, a swing holder 123, a coil spring 125, a cover unit 128 including a top cover 126 and a base cover 124, and the like.

The one end of the rotary shaft 121*a* of the sheet separating roller 121 is rotatably supported by and connected to the torque limiter 122. The functions of the torque limiter 122 are previously described above. The torque limiter 122 and the sheet separating roller 121 are held by the swing holder 123. The other side of the torque limiter 122, which is an opposite side thereof facing and being connected to the rotary shaft 121*a* of the sheet separating roller 121, is fixedly attached to a right side plate of the swing holder 123. Further, the other end of the rotary shaft 121*a* of the sheet separating roller 121 is rotatably supported by a left side plate of the swing holder 123.

Accordingly, the swing holder 123 that holds the torque limiter 122 and the sheet separating roller 121 is contained in the cover unit 128 that functions as a containing device including the top cover 126 and the base cover 124. Specifically, respective swing shafts 123*a* are provided along a coaxial line on both the right side plate and the left side plate of the swing holder 123. The base cover 124 has a shaft hole 124*a* and a cutout 124*b*. One of the swing shafts 123*a* is engaged with the shaft hole 124*a* and the other of the swing shafts 123*a* is engaged with the cutout 124*b*. Accordingly, the swing holder 123 is supported by the base cover 124 so as to rotate about the swing shafts 123*a*.

The top cover 126 fits to the base cover 124 from above. In this state, a circumferential surface of the sheet separating roller 121 disposed inside the cover unit 128 is exposed through an opening 126*a* of the top cover 126 (see FIG. 12). The base cover 124 further includes the coil spring 125 that functions as a spring or a biasing member. The coil spring 125 is fixed to the base cover 124, so that the coil spring 125 biases the swing holder 123 centering the swing shaft 123*a* from the base cover 124 toward the top cover 126. When the separation roller unit 120 is not attached to the sheet tray 100 as illustrated in FIG. 12, the circumferential surface of the sheet separating roller 121 contacts a rear side of the top cover 126.

In the image forming apparatus 1000 according to this example, a right end face of the apparatus body 50 in FIG. 1 is a front side of the image forming apparatus 1000 and a left end face of the apparatus body 50 is the rear side of the image forming apparatus 1000. A far side or an inward side in a direction perpendicular to a sheet face of FIG. 1 is a right side of the apparatus body 50 and a near side or an outward side in the direction perpendicular to the sheet face of FIG. 1 is a left side thereof. Specifically, when detaching the sheet tray 100 that is placed inside the apparatus body 50 of the image forming apparatus 1000, a user pulls out the sheet tray 100 to the front side of the apparatus body 50. By contrast, when attaching the sheet tray 100, the user inserts the sheet tray 100 into the apparatus body 50 toward the rear side of the image forming apparatus 1000. Hereinafter, a direction from the rear side to the front side of the image forming apparatus 1000 along a tray attaching/detaching direction is referred to as a "front side direction" and an opposite direction to the front side direction is referred to as a "rear side direction".

Figure 14:
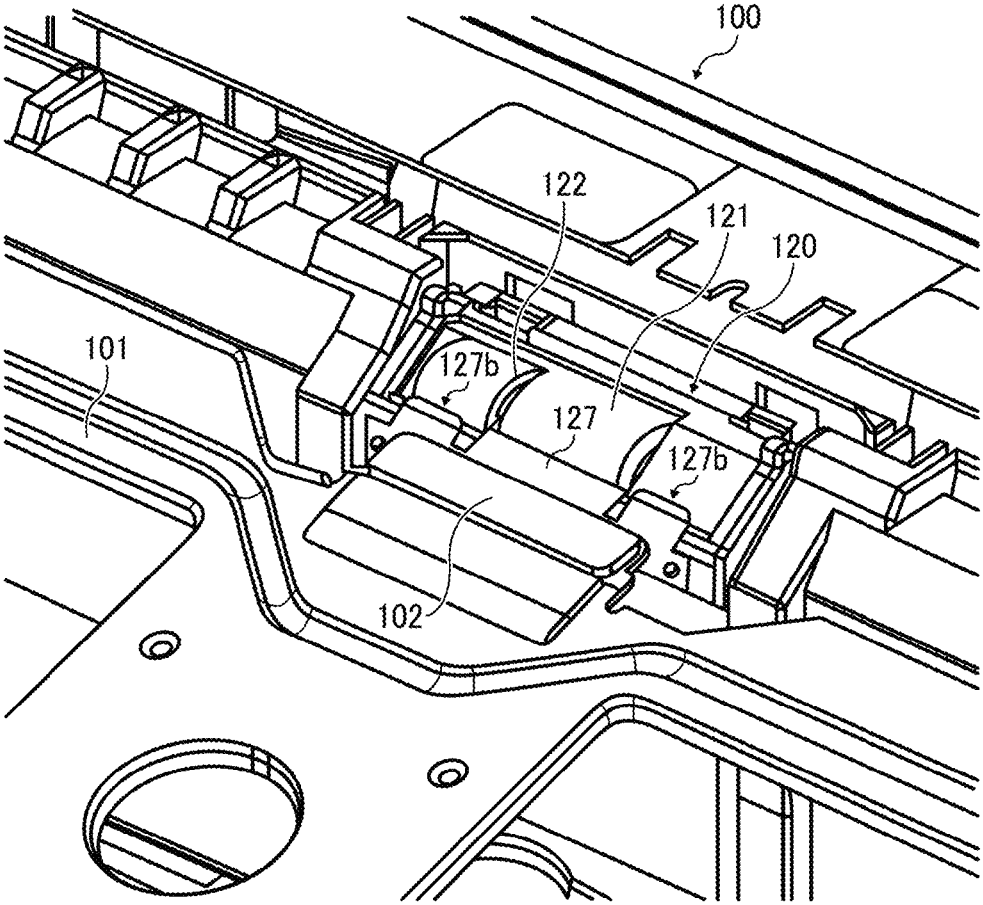
FIG. 14 is a partial perspective view illustrating a front end part of the sheet tray.

As illustrated in FIG. 14, when the separation roller unit 120 is attached to an attaching part of the sheet tray 100, the bottom plate pad 102 that is fixedly attached to a leading end of the movable bottom plate 101 of the sheet tray 100 comes in the vicinity of the rear side of the sheet separating roller 121. As described above, the bottom plate pad 102 presses the sheet S accommodated in the sheet tray 100 toward the sheet feed roller 35.

Figure 15:
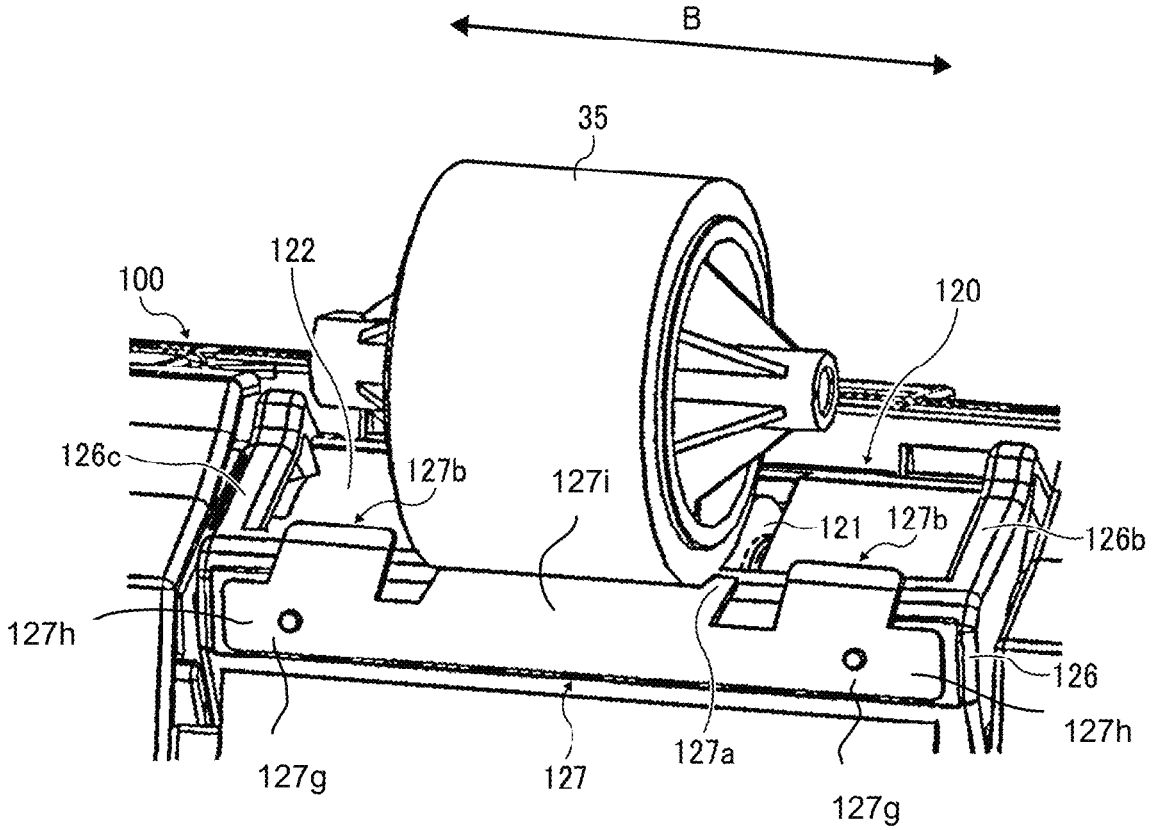
FIG. 15 is a partial perspective view illustrating the separation roller unit of the sheet tray installed in the apparatus body and a sheet feeding roller attached in the apparatus body.

FIG. 15 is a partial perspective view illustrating a part of the separation roller unit 120 of the sheet tray 100 attached to a housing of the apparatus body 50 and the sheet feed roller 35 fixedly provided to the housing of the apparatus body 50.

In the process of attaching the sheet tray 100 to the apparatus body 50 by slidably inserting the sheet tray 100 into the apparatus body 50, the sheet feed roller 35 that is fixedly provided in the apparatus body 50 contacts the sheet separating roller 121 that is held by the sheet tray 100. Specifically, part of the outer circumferential surface of the sheet separating roller 121 before contacting the sheet feed roller 35 projects more outwardly than the top cover 126 through the opening 126*a* (FIG. 13) of the top cover 126 of the separation roller unit 120. In this state, the sheet separating roller 121 is pushed into the apparatus body 50 together with the sheet tray 100, and eventually abuts against the outer circumferential surface of the sheet feed roller 35 that is fixedly provided to the apparatus body 50.

As the sheet tray 100 is further pushed and inserted into the apparatus body 50, the sheet separating roller 121 is pushed back by the sheet feed roller 35. Due to the push-back force of the sheet feed roller 35, the swing holder 123 starts to rotate about the swing shaft 123*a* from the top cover 126 toward the base cover 124 against the biasing force of the coil spring 125. By so doing, the sheet separating roller 121 gradually rotates about the swing shaft 123*a* from the sheet feed roller 35 toward the sheet separating roller 121. Accordingly, the contact part of both rollers gradually moves from the sheet feed roller 35 toward the sheet separating roller 121. When the sheet tray 100 is pushed to a regular attachment position, the sheet separating roller 121 is detached from the rear side of the top cover 126 completely.

When a sheet having a large rigidity such as a thick paper is used as the sheet S, it is likely that the large rigidity of the sheet S that is held in the sheet separation nip region applies a force to the sheet separating roller 121 to separate from the sheet feed roller 35. This application of the force to separate from the sheet feed roller 35 causes misfeed of the sheet S due to the force. Specifically, due to the force, the swing holder 123 that is biased by the coil spring 125 as illustrated in FIG. 13 toward the sheet feed roller 35 rotates about the swing shaft 123*a* in a direction to separate from the sheet feed roller 35, so as to cause the sheet separating roller 121 to separate largely from the sheet feed roller 35. With this operation, a sheet conveying force applied by the surface movement of the sheet feed roller 35 is not transmitted to the sheet S, which causes misfeed of the sheet S. Hereinafter, this misfeed is referred to as "misfeed due to pressing back".

FIG. 16 illustrates a vertical cross sectional view of the sheet feed roller 35 and the separation roller unit 120 of FIG. 15.

The image forming apparatus 1000 further includes a projection 126*b* and a projection 126*c* in the vicinity of the opening 126*a* on the top cover 126 of the separation roller unit 120, as illustrated in FIG. 15. The projections 126*b* and 126*c* are aligned in the roller axis direction or rotation of the cylindrical roller part 121*b* of the sheet separating roller 121.

In FIG. 16, a dot-dashed line with a reference sign "Ln" indicates an extension of a straight line from the sheet separation nip region and another dot-dashed line with a reference sign "Ls" indicates an extension of a straight line from respective surfaces of the projections 126*b* and 126*c*.

The projection 126*b* is aligned facing an end surface (i.e., the right end surface in FIG. 16) in the roller axis direction or rotation of the cylindrical roller part 121*b* of the sheet separating roller 121 and projects toward the sheet feed roller 35 than the sheet separation nip region in the apparatus body 50. That is, the projection 126*b* is disposed at a position at one end of the rotary shaft 121*a* of the sheet separating roller 121 from the cylindrical roller part 121*b* in the roller axis direction of the rotary shaft 121*a* thereof and projecting beyond the sheet separation nip region toward the sheet feed roller 35 in the apparatus body 50.

Further, the projection 126*c* is aligned facing an opposite end surface (i.e., the left end surface in FIG. 16) in the roller axis direction or rotation of the roller part 121*b* of the sheet separating roller 121 and projects toward the sheet feed roller 35 than the sheet separation nip region in the apparatus body 50. That is, the projection 126*c* is disposed at a position at an opposite end to the one end of the rotary shaft 121*a* of the sheet separating roller 121 from the cylindrical rotary shaft 121*a* in the roller axis direction and projecting beyond the sheet separation nip region toward the sheet feed roller 35 in the apparatus body 50.

Figure 17:
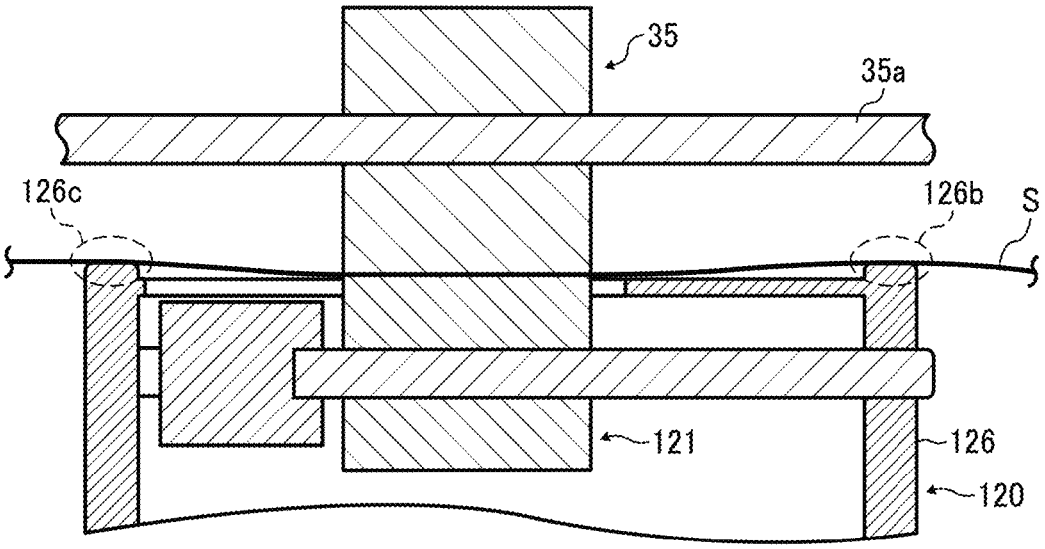
FIG. 17 is a vertical cross sectional view illustrating a state in which the sheet feeding roller and the separation roller unit hold a sheet having a high rigidity in a sheet separation nip region formed therebetween.

As illustrated in FIG. 17, when the sheet S having a large rigidity is sandwiched in the sheet separation nip region, the sheet S becomes to have two slightly warping contact areas thereon in the entire region of the sheet S in the roller axis direction of the sheet S. Specifically, the sheet S slightly warps at a contact area contacting with the projection 126*b* and at another contact area contacting with the projection 126*c*. More specifically, the contact areas of the sheet S warp more toward the sheet separation nip region on the side of the sheet separating roller 121 than respective surfaces of the contact areas. Since the sheet S illustrated in FIG. 17 has a large rigidity, the sheet S attempts to eliminate the warp with a restoring force that is exerted by the sheet S. Therefore, the sheet S does not apply the force to separate the sheet separating roller 121 from the sheet feed roller 35. Accordingly, occurrence of misfeed due to pressing back that is caused by which the sheet S having a large rigidity applies the above-described force to the sheet separating roller 121 in the sheet separation nip region can be prevented.

In FIG. 16, the sheet separating roller 121 has the circumferential surface, a part of which projects outside through the opening 126*a* of the top cover 126. The part, which is hereinafter referred to as a "projecting surface", projects toward the sheet feed roller 35 from a surface of the top cover 126.

If the sheet S having a large rigidity abuts against the projecting surface of the sheet separating roller 121 before reaching the sheet separation nip region, the swing holder 123 rotates about the swing shaft 123*a* to a direction to separate from the sheet feed roller 35. It is likely that this rotation of the swing holder 123 significantly separates the sheet separating roller 121 from the sheet feed roller 35 to cause misfeed of the sheet S. Hereinafter, this misfeed is referred to as "misfeed due to abutment". Specifically with a configuration in which the driving force of the motor is not transmitted to the sheet separating roller 121 as the image forming apparatus 1000 according to this example, even if the sheet S abuts against the projecting surface of the sheet separating roller 121 to stop the rotation of the sheet separating roller 121, no driving force to rotate the sheet separating roller 121 reversely is transmitted. Accordingly, no force is applied with respect to the sheet S that abuts against the projecting surface of the sheet separating roller 121 to push the sheet S back to the sheet tray 100. Therefore, it is likely to cause the misfeed due to abutment of the sheet S easily.

Therefore, the image forming apparatus 1000 further includes a guide unit panel 127 that is fixedly attached to the top cover 126, as illustrated in FIG. 15. The guide unit panel 127 includes a sheet separation nip guide 127*a*, two bend applying members 127*b*, a base 127*g* disposed at both sides of a guide unit panel 127, a side projection 127*h* at opposing ends of the guide unit panel 127 and a coupling portion 127*i* between the two bases. The sheet separation nip guide 127*a* is disposed at a position upstream from the roller part 121*b* of the sheet separating roller 121 in the sheet conveying direction and contacts the sheet S before the sheet separation nip region. By so doing, the sheet separation nip guide 127*a* prevents abutment of the sheet S against the projecting surface of the sheet separating roller 121 of the separation roller unit 120 before the sheet S enters the sheet separation nip region and, at the same time, guides the sheet S toward the sheet separation nip region. By preventing the abutment of the sheet S against the projecting surface of the sheet separating roller 121, the misfeed due to abutment of the sheet S can be avoided.

Detailed functions of the two bend applying members 127*b* of the guide unit panel 127 are described below.

Now, a description is given of an image forming apparatus 1000 according to an example of this disclosure.

As previously described, when a sheet having a small rigidity such as a thin paper is used as the sheet S in an image forming apparatus having a pickup-less structure such as the image forming apparatus 1000, it is likely that crease is generated on the sheet S by producing waves as illustrated in FIG. 5 before entering the sheet separation nip region.

Figure 18:
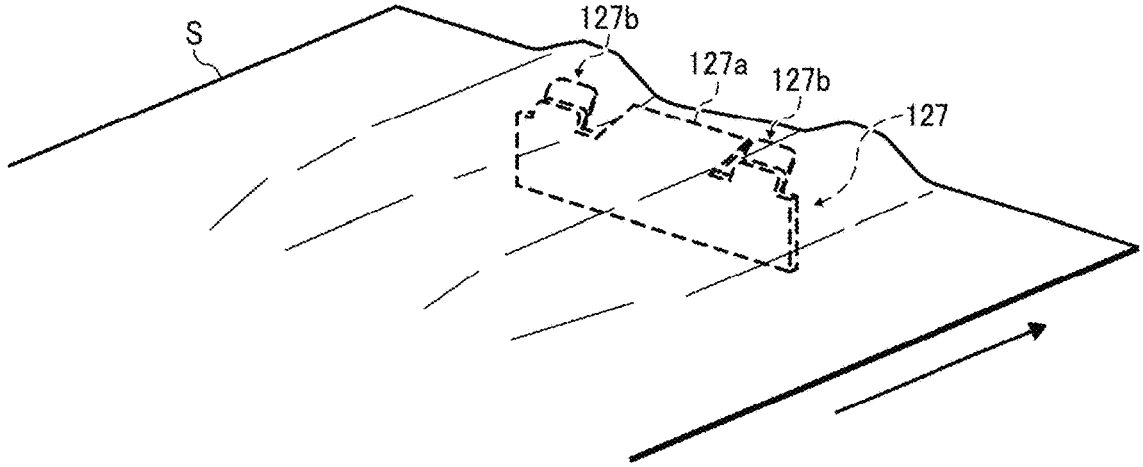
FIG. 18 is a perspective view illustrating a guide unit panel of the image forming apparatus with a sheet thereon.

To address this inconvenience, the image forming apparatus 1000 includes two bend applying members 127*b* provided to the guide unit panel 127, as illustrated in FIG. 15. The bend applying members 127*b* contact the sheet S from below in the direction of gravitation immediately before the sheet S enters the sheet separation nip region. By so doing, as illustrated in FIG. 18, the sheet S having a small rigidity is bent so that wrinkles are produced along the sheet conveying direction as indicated by arrow. This bend, which is also referred to as a first bend, hinders occurrence of a second bend in a direction perpendicular to the first bend (FIG. 5) As a result, generation of crease on the sheet S can be prevented.

In FIG. 15, the sheet separation nip guide 127*a* is formed by a bending process by bending part of a sheet metal SM of a body of the guide unit panel 127. Further, respective root ends of the two bend applying members 127*b* are formed by a bending process by bending part of the sheet metal SM of the body of the guide unit panel 127. The bend applying members 127*b* have respective leading ends to contact the rear surface of the sheet S. While the root ends of the bend applying members 127*b* are part of the body of the guide unit panel 127, the leading ends are different parts.

If a member that is bend by the bending process over the entire part from the leading end to the root end is used, the member easily cause "misfeed due to slip" in addition to "misfeed due to pressing back" and "misfeed due to abutment". The misfeed due to slip is caused as follows. When the bend applying member strongly presses the sheet S to the sheet feed roller, a large conveying resistance is applied to the sheet S, so that the sheet S slips on the surface of the sheet feed roller. Due to this slip of the sheet S, the sheet S cannot be forwarded in the sheet conveying direction and, as a result, the misfeed due to slip is caused.

Figure 19:
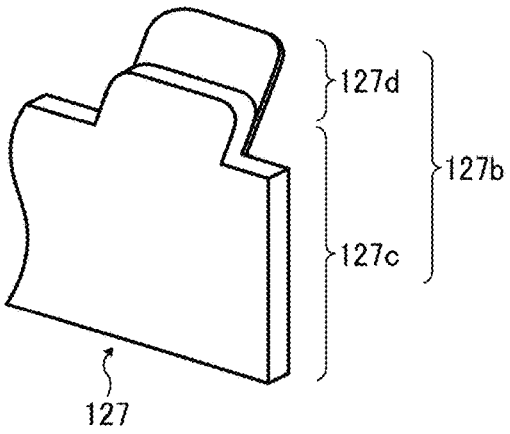
FIG. 19 is an enlarged perspective view illustrating a bend applying member provided to the guide unit panel.

To address this inconvenience, in the image forming apparatus 1000, each of the bend applying members 127*b* includes a leading end 127*d* to contact the sheet S and, of the entire part of the bend applying member 127*b*, the leading end 127*d* is formed by a different material part from a body 127*c* of the bend applying member 127*b*, as illustrated in FIG. 19. Specifically, as an example of such a material, the leading end 127*d* employs the resin sheet RS that is a flexible member. The resin sheet RS can freely bend when a certain amount of force is applied thereto. However, when the resin sheet RS contacts the sheet S having a small rigidity such as thin paper is used, due to the higher rigidity than the thin paper, the resin sheet RS does not bend and remains straight. Accordingly, the sheet S having a smaller rigidity is bent as illustrated in FIG. 18, so that generation of waves can be prevented. As a result, generation of crease on the sheet S can be prevented.

Figure 20:
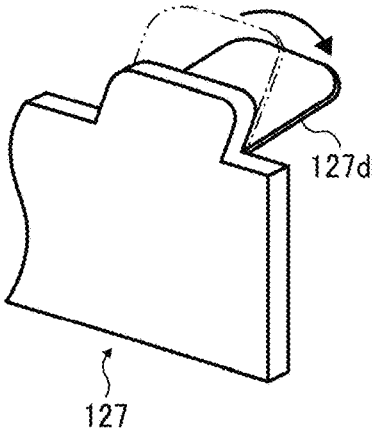
FIG. 20 is an enlarged perspective view illustrating the bend applying member with a leading end bent.

By contrast, when the resin sheet RS contacts the sheet S having a large rigidity such as thick paper is used, the resin sheet RS bends flexibly toward a downstream side in the sheet conveying direction, as illustrated in FIG. 20. By bending as described above, a force to press the sheet in the sheet separation nip region toward the sheet feed roller 35 is reduced, and therefore the resistance of conveyance is also reduced. As a result, occurrence of the misfeed due to slip of the sheet S having a high rigidity can be prevented.

Figure 21:
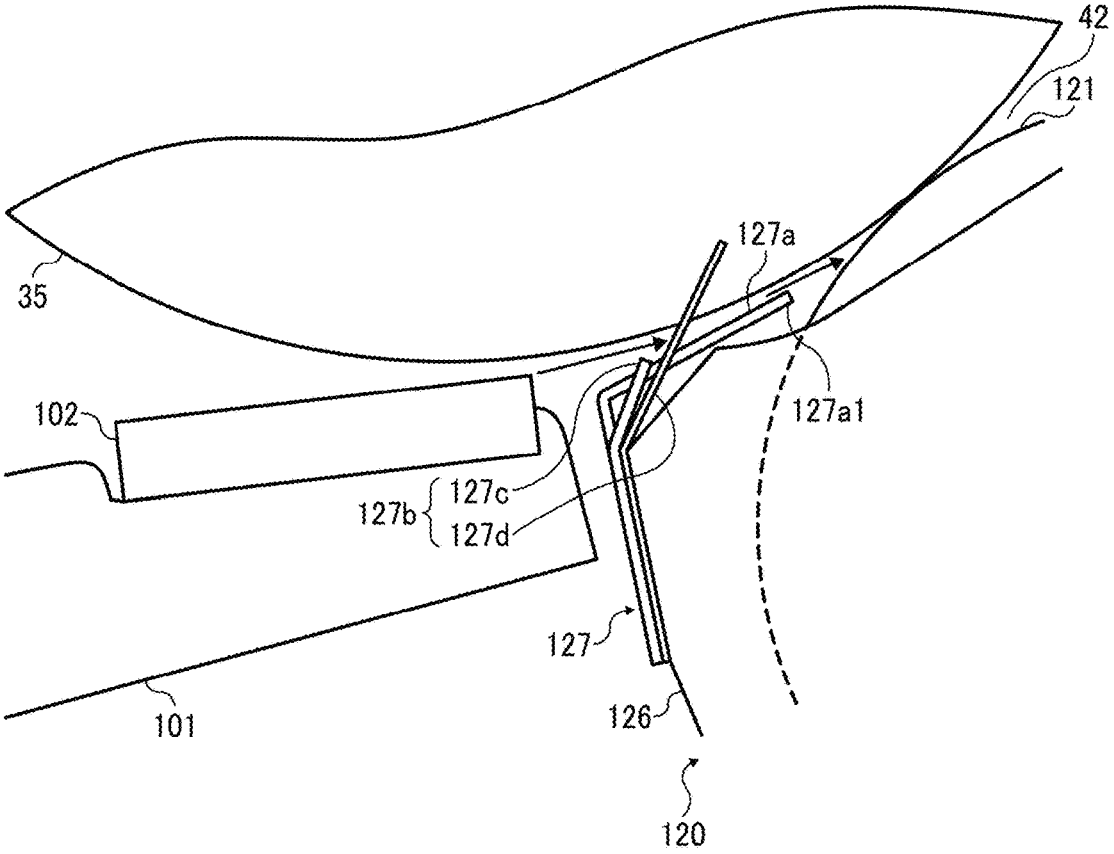
FIG. 21 is an enlarged view illustrating a sheet separation nip region of the image forming apparatus and components around the sheet separation nip region.

FIG. 21 is an enlarged view illustrating the sheet separation nip region of the image forming apparatus 1000 and components around the sheet separation nip region.

In FIG. 21, arrows indicate a travel course of the sheet S in the sheet conveying path 42 from the bottom plate pad 102 of the movable bottom plate 101 to the sheet separation nip region. The sheet S, which is not illustrated in FIG. 21, has a relatively thin sheet, and therefore enters in the sheet separation nip region substantially along a line indicated by the arrows.

The bend applying member 127*b* of the guide unit panel 127 has the body 127*c* that is the sheet metal SM that is disposed below the travel course of the sheet S in the sheet conveying path 42 indicated by the arrows in FIG. 21, which is close to the sheet separating roller 121. Therefore, it is rare that the sheet S contacts the body 127*c*. By contrast, it is clearly observed that the leading end 127*d* made of the resin sheet RS projects significantly upward in the direction of gravitation above the travel course of the sheet S in the sheet conveying path 42, which is close to the sheet feed roller 35. This significant upward projection of the leading end 127*d* in the direction of gravitation above the travel course of the sheet S in the sheet conveying path 42 as illustrated in FIG. 21 causes the bend applying member 127*b* to contact the sheet S to produce wrinkles on the sheet S by bending. By contrast, the body 127*c* of the sheet metal SM is disposed below the travel course of the sheet S in the sheet conveying path 42 in the direction of gravitation, and this configuration can prevent the sheet S from being pushed toward the sheet feed roller 35.

It is to be noted that the bend applying member 127*b* illustrated in FIG. 21 is disposed at a front side of a roller part of the sheet feed roller 35 and a roller part of the sheet separating roller 121 in the roller axis direction. Accordingly, the sheet S is lifted by the bend applying member 127*b* at a position of the bend applying member 127*b* upward and higher than the travel course of the sheet S in the sheet conveying path 42 in the roller axis direction and is moved in the sheet conveying path 42 in the sheet separation nip region.

Figure 22:
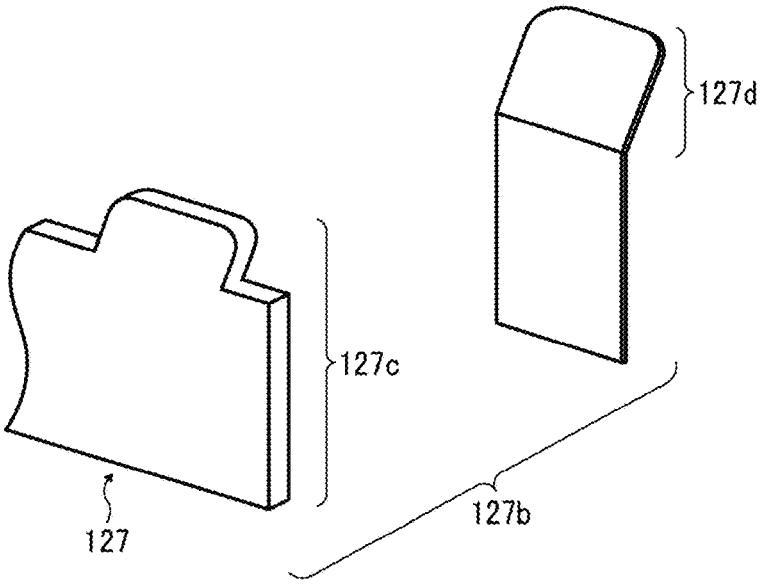
FIG. 22 is an enlarged exploded perspective view illustrating the bend applying member focused on functions thereof.

FIG. 22 is an enlarged exploded perspective view illustrating the bend applying member 127*b* of the guide unit panel 127, focused on functions of the bend applying member 127*b*.

As illustrated in FIG. 22, the bend applying member 127*b* is formed by a sheet metal SM that is a body forming member that forms the body 127*c* and the resin sheet RS that is a leading end forming member that forms the leading end 127*d*. Accordingly, the resin sheet RS employed as material of the leading end 127*d* can easily provide a desired flexibility to the leading end 127*d* as designed.

Figure 23:
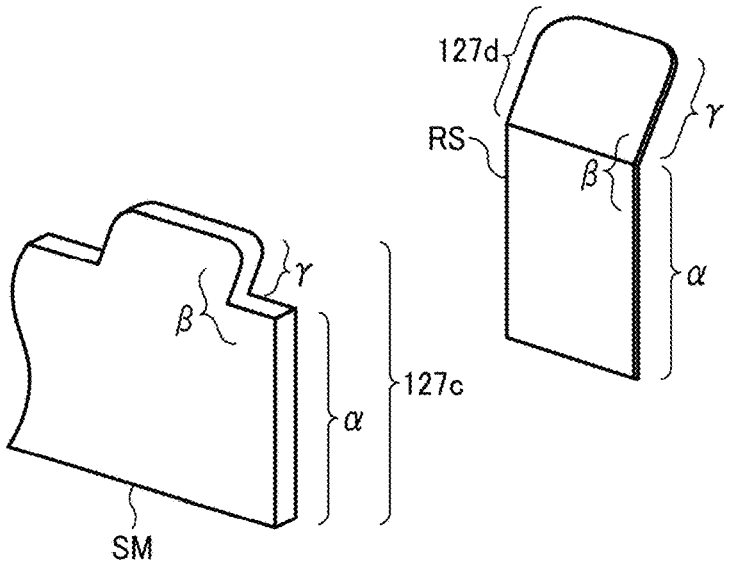
FIG. 23 is an enlarged exploded perspective view illustrating the bend applying member focused on materials thereof.

As illustrated in FIG. 23, both the sheet metal SM forming the body 127*c* of the bend applying member 127*b* and the resin sheet RS forming the leading end 127*d* of the bend applying member 127*b* include an upright portion α, a bent portion β, and a leading extended portion γ. The upright portion α is a part extending upwardly in the direction of gravitation. The bent portion β is a part that is bent from the sheet tray 100 toward the sheet separation nip region at an upward end position of the upright portion α in the sheet conveying direction. The leading extended portion γ is a part that extends from the bent portion β toward the leading end 127*d* that contacts the sheet S.

Figure 24:
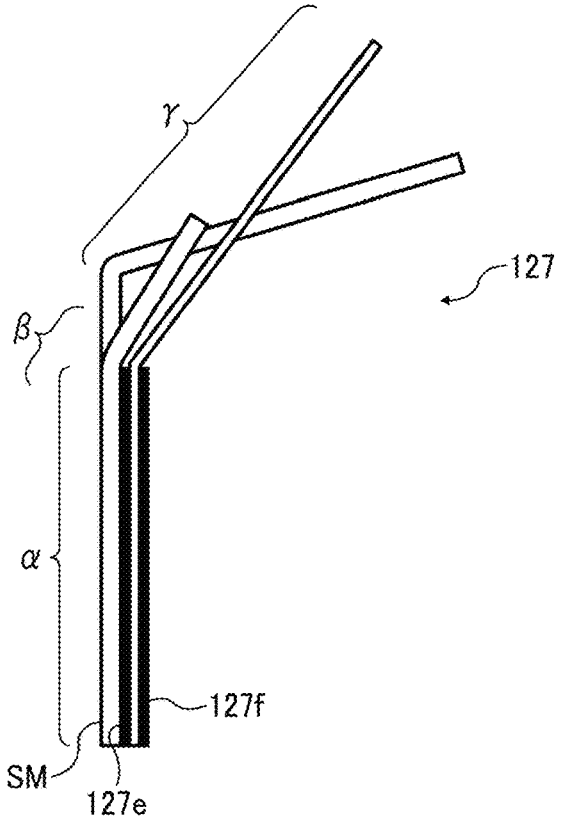
FIG. 24 is a side view illustrating the guide unit panel.

FIG. 24 is a side view illustrating the guide unit panel 127.

A direction from left to right in FIG. 24 is the sheet conveying direction. A right-side area from the guide unit panel 127 in FIG. 24 is an area to the sheet separating roller 121 in the sheet conveying direction. A light-side area from the guide unit panel 127 in FIG. 24 is an area to the sheet tray 100 in the sheet conveying direction. A surface of the upright portion α of the resin sheet RS as a leading end forming member in the sheet conveying direction of the upright portion α on the side of the sheet tray 100 is fixedly attached by a double-sided tape 127*e* to a surface of the upright portion α of the sheet metal SM as a body forming member in the sheet conveying direction on the side of the sheet separation nip region α. Further, a surface of the upright portion α of the resin sheet RS as a leading end forming member on the side of the sheet separating roller 121 is fixedly attached by a double-sided tape 127*f* to the top cover 126 of the separation roller unit 120 illustrated in FIG. 13. Due to these attachments, the leading end 127*d* formed by the resin sheet RS of the bend applying member 127*b* is firmly attached to the body 127*c* of the sheet metal SM.

However, the leading extended portion γ of the leading end forming member formed by the resin sheet RS is not attached to the sheet metal SM or other members. The leading extended portion γ of the leading end forming member formed by the resin sheet RS is supported by the bent portion β of the leading end forming member formed by the resin sheet RS in a cantilever manner without being attached to the leading extended portion γ of the body forming member of the sheet metal SM in a state in which the leading extended portion γ of the leading end forming member formed by the resin sheet RS is disposed below the leading extended portion γ of the body forming member of the sheet metal SM in the direction of gravitation. Accordingly, the leading extended portion γ of the resin sheet RS, which functions as the leading end 127*d* of the bend applying member 127*b* can freely swing (bend) about the bent portion β of the resin sheet RS. In addition, compared to a case in which the leading extended portion γ of the resin sheet RS is attached to a lower surface of the leading extended portion γ of the sheet metal SM, the leading end 127*d* can be bent preferably. In a case in which the leading extended portion γ of the resin sheet RS is attached to the lower surface of the leading extended portion γ of the sheet metal SM, the leading extended portion γ of the resin sheet RS and the upright portion α are attached to the respective sheet metals SM with the bent portion β of the resin sheet RS therebetween. However, this case degrades operability significantly. In this example, the resin sheet RS is allowed to be attached to a single position of the upright portion α. By so doing, degradation in operability can be prevented.

In FIG. 23, the leading extended portion γ of the resin sheet RS, which forms the leading end 127*d* of the bend applying member 127*b* illustrated in FIG. 22, has corners chamfered into a curved shape. This chamfering can prevent occurrence of damage or scratches to the sheet S due to a corner of the leading end 127*d* sliding on the sheet S.

Similarly, the leading extended portion γ of the sheet metal SM, which forms the body 127*c* of the bend applying member 127*b* illustrated in FIG. 22, has corners chamfered into a curved shape. According to this chamfering, even when the sheet S having a large rigidity bends the leading end 127*d* to contact the body 127*c*, the corner of the body 127*c* does not rub the sheet S. Since the corner of the body 127*c* of the sheet metal SM does not rub the sheet S having a large rigidity, occurrence of damage or scratch to the sheet S can be prevented. To be more specific, in a paper jam handling with the sheet S having a large rigidity, there is a case in which a user pulls out the sheet S with a large force to take the jammed sheet S out of the image forming apparatus 1000. During this handling, even if the sheet S rubs the body 127*c* that is the sheet metal SM, the corner of the body 127*c* does not abut against the sheet S, and therefore occurrence of damage or scratch to the sheet S can be avoided.

As illustrated in FIG. 18, the image forming apparatus 1000 includes the two bend applying members 127*b* contacting at different positions on the guide unit panel 127 in a direction perpendicular to the sheet conveying direction that is indicated by an arrow in FIG. 18. Hereinafter, the direction perpendicular to the sheet conveying direction is referred to as a perpendicular sheet conveying direction. According to this configuration, two wrinkles parallel to each other in the perpendicular sheet conveying direction of the sheet S are generated, so that wave forming on the sheet S can be prevented with a greater force. As a result, generation of crease on the sheet S can be prevented more reliably.

When wrinkles generated on the sheet S bent by the bend applying members 127*b* come to the sheet separation nip region, the sheet S is likely to have crease thereon. Specifically, it is likely that the bend applying members 127*b* provided to prevent generation of crease can promote generation of crease.

To address this inconvenience, the image forming apparatus 1000 includes the configuration as illustrated in FIG. 15. Specifically, in FIG. 15 that shows a schematic cylindrical roller part of the sheet separating roller 121, one of the two bend applying members 127*b* is located at a position shifted to one side (a right side in FIG. 15) of the roller part of the sheet separating roller 121 in a rotation axis direction B of the sheet separating roller 121 and the sheet feed roller 35 and the other is located at a position shifted to the other side (a left side in FIG. 15) of the roller part of the sheet separating roller 121 in the rotation axis direction B. By locating the bend applying members 127*b* as described above, both of the two wrinkles generated on the sheet S by the bend applying members 127*b* in FIG. 18 are located outside the sheet separation nip region in the rotation axis direction B. This configuration can prevent generation of crease when wrinkles generated on the sheet S by the bend applying members 127*b* enter the sheet separation nip region.

As illustrated in FIG. 21, an extending direction of a guide part 127*a*1 that is a leading end of the sheet separation nip guide 127*a* of the guide unit panel 127 is different from an extending direction of the leading end 127*d* of the bend applying member 127*b* of the guide unit panel 127. By having different extending directions, the guide unit panel 127 can preferably obtain a function in which the sheet separation nip guide 127*a* guides the sheet S to the sheet separation nip region and another function in which the bend applying members 127*b* causes the sheet S to have wrinkles on the sheet S to prevent generation of waves on the sheet S. In the image forming apparatus 1000, the extending direction of the guide part that is the leading end of the sheet separation nip guide 127*a* is more angled toward a horizontal direction than the extending direction of the leading end 127*d* of the bend applying member 127*b*. By arranging these parts described above, these two functions of the guide unit panel 127 are preferably performed individually.

Figure 25:
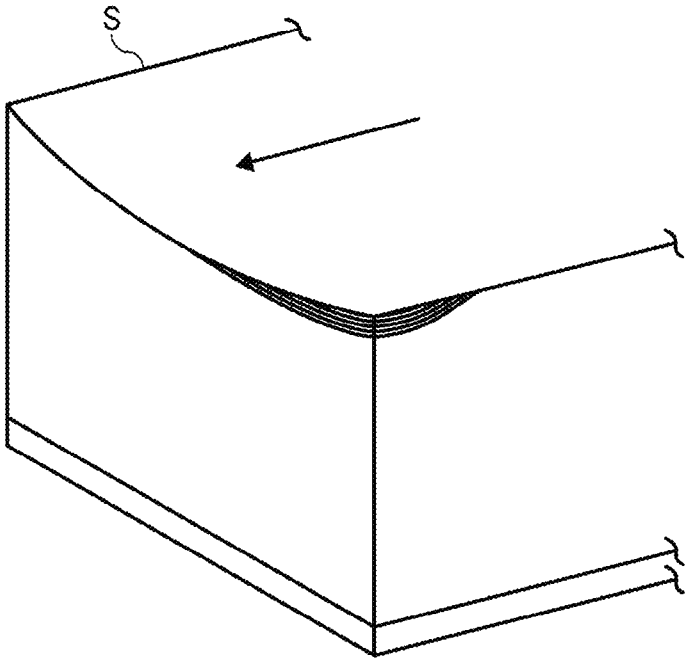
FIG. 25 is a perspective view illustrating a sheet bundle, part of which is curled in the sheet tray.
Figure 26:
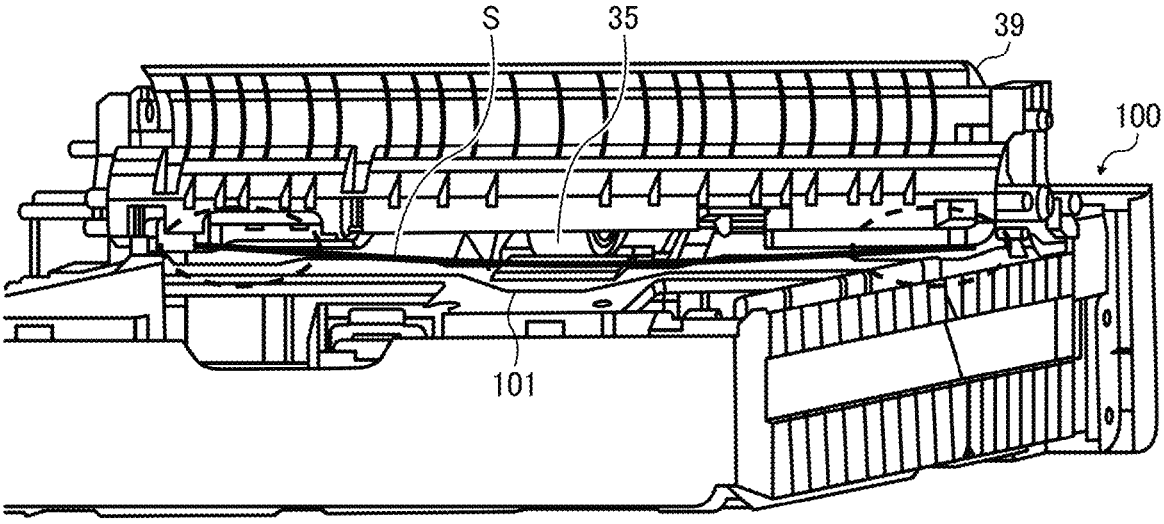
FIG. 26 is a perspective view illustrating the sheet tray and a sheet feed roller unit case.

In addition to the misfeed due to pressing back, the misfeed due to abutment, and the misfeed due to slip described as possible misfeeds in the image forming apparatus 1000 as above, there is another possible misfeed, which is "misfeed due to curled sheet". As illustrated in FIG. 25, the misfeed due to curled sheet" is caused when one or more sheets S accommodated in the sheet tray 100 are curled upwards at both edges in a direction perpendicular to the sheet conveying direction (as indicated by arrow in FIG. 25) and projected higher than the center part of the sheet S. When the sheets S are curled as illustrated in FIG. 25, the edges projecting upwards abut against a sheet feed roller unit case 39 immediately after fed form the sheet tray 100, as illustrated in FIG. 26. This abutment makes it difficult for the sheet S to move to the sheet separation nip region. Accordingly, the misfeed due to curled sheet occurs.

Figure 27:
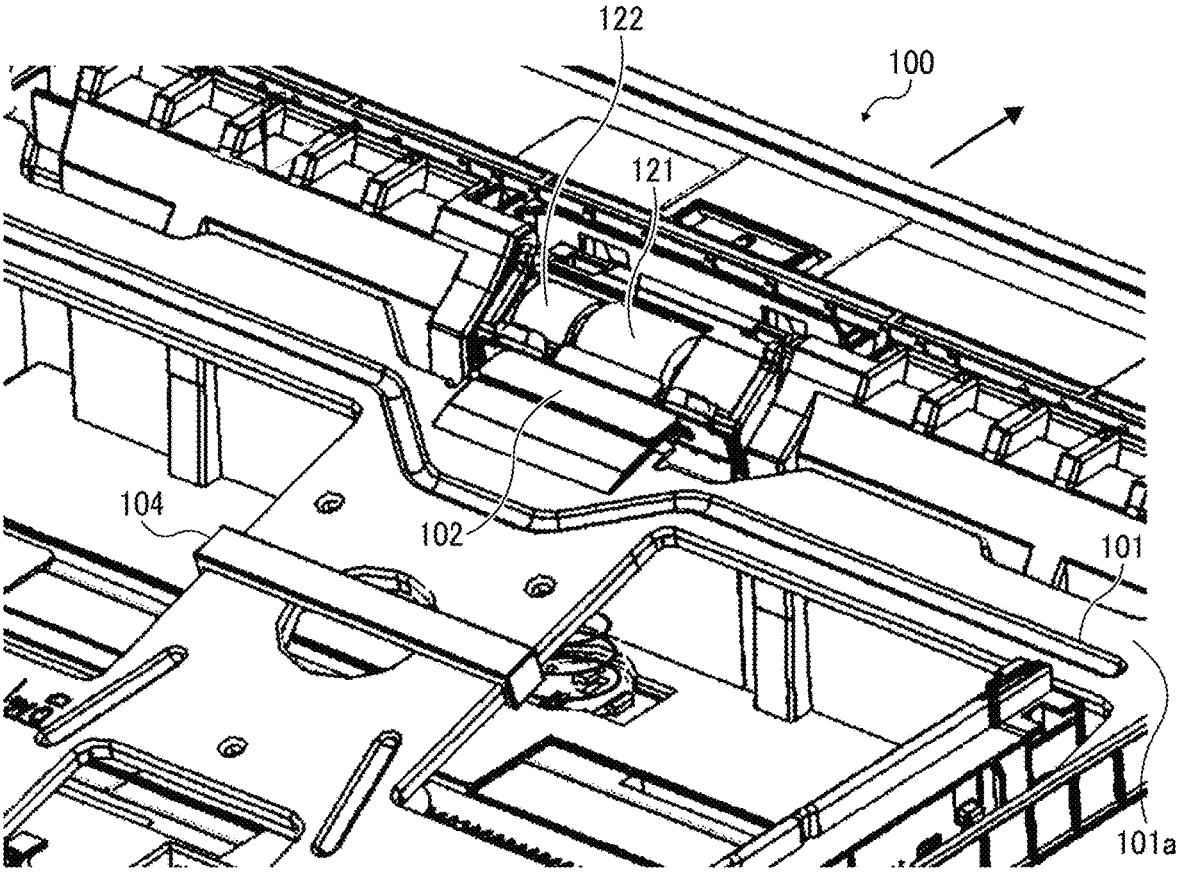
FIG. 27 is a perspective view illustrating part of the sheet tray, viewed from an oblique upper side.

To address this inconvenience, the image forming apparatus 1000 includes a curl correcting body 104 attached to the movable bottom plate 101 of the sheet tray 100, as illustrated in FIG. 27.

The curl correcting body 104 is disposed projecting upward above a sheet loading face 101*a* of the movable bottom plate 101 and contacts the center part of the sheet S in the sheet tray 100 in a direction perpendicular to a sheet feeding direction (as indicated by arrow in FIG. 27). Hereinafter, the direction perpendicular to the sheet feeding direction is referred to as a "perpendicular feed direction". This contact presses the center part of the sheet S in the perpendicular feed direction upward, so as to correct the curling of the sheet S.

Figure 28:
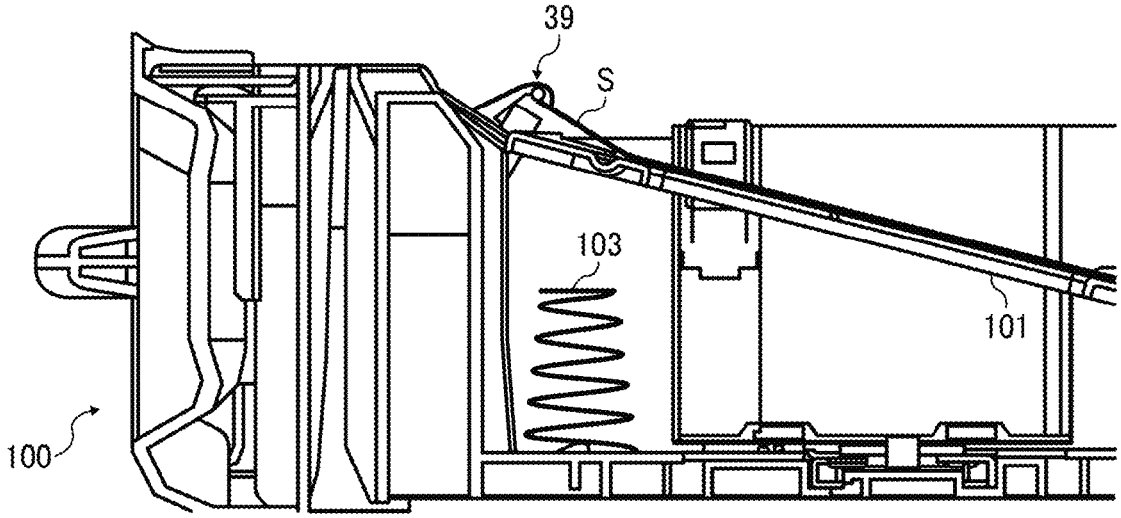
FIG. 28 is a diagram illustrating a sheet placed in a sheet tray without a curl correcting body provided thereto.

If the sheet tray 100 does not include the curl correcting body 104, both edges at the leading end of the sheet S in the sheet tray 100 in the perpendicular feed direction project upward and higher than the sheet loading face of the sheet tray 100, as illustrated in FIG. 28. As illustrated in FIG. 28, the projecting part of the leading end of the sheet S abuts against the sheet feed roller unit case 39.

Figure 29:
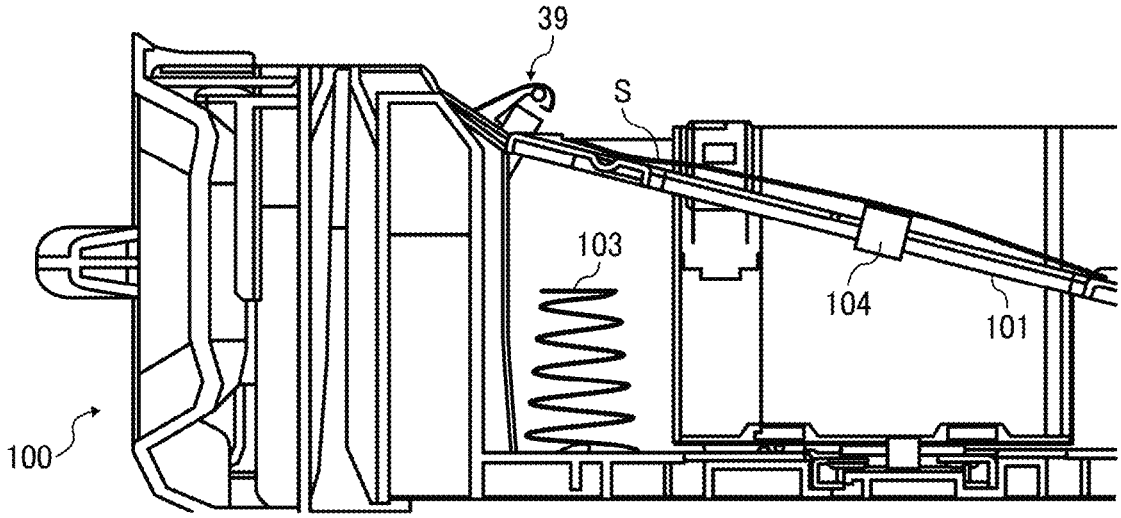
FIG. 29 is a diagram illustrating a sheet placed in a sheet tray with a curl correcting body provided thereto.

Different from the above-described configuration without the curl correcting body 104, the image forming apparatus 1000 includes the sheet tray 100 having the curl correcting body 104, and therefore the entire area of the leading end in the perpendicular feed direction of the sheet S stored in the sheet tray 100 closely contacts the sheet loading face of the sheet tray 100, as illustrated in FIG. 29. When being fed from the sheet tray 100 in this state, the sheet S can reach the sheet separating roller 121 and enter the sheet separation nip region without abutting against the sheet feed roller unit case 39.

Figure 30:
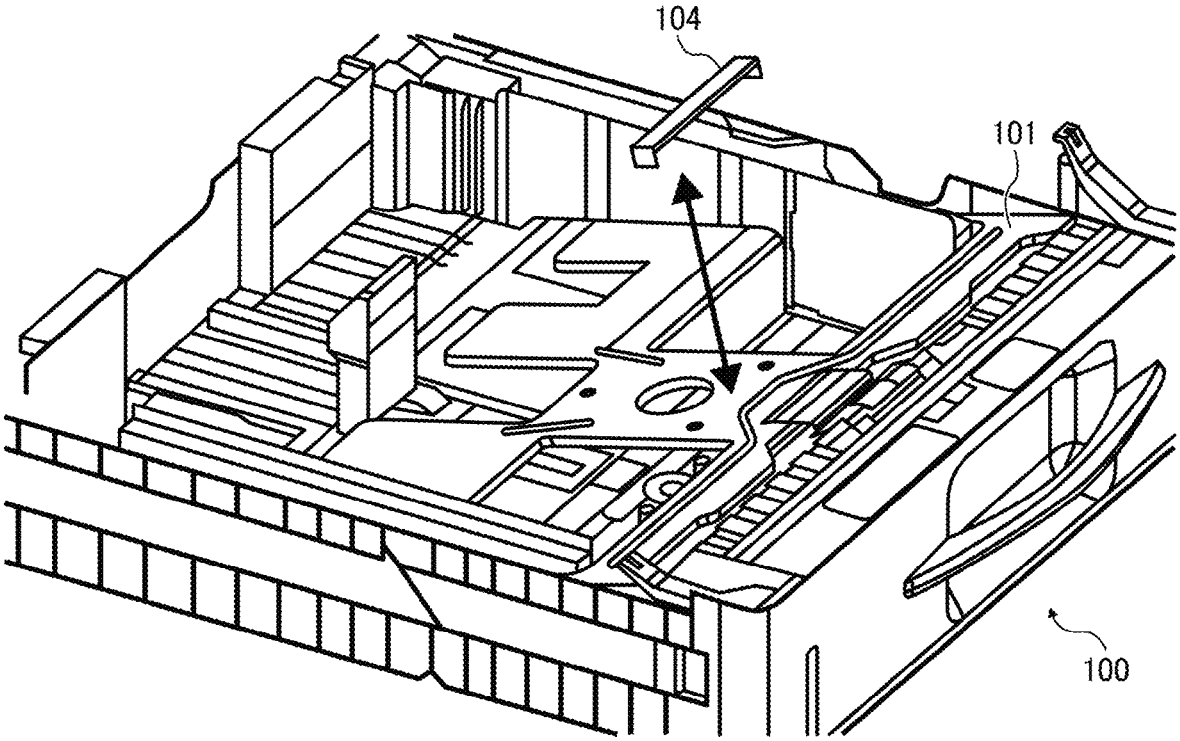
FIG. 30 is a perspective view illustrating the sheet tray having the curl correcting body that is detachably attached thereto.
Figure 31:
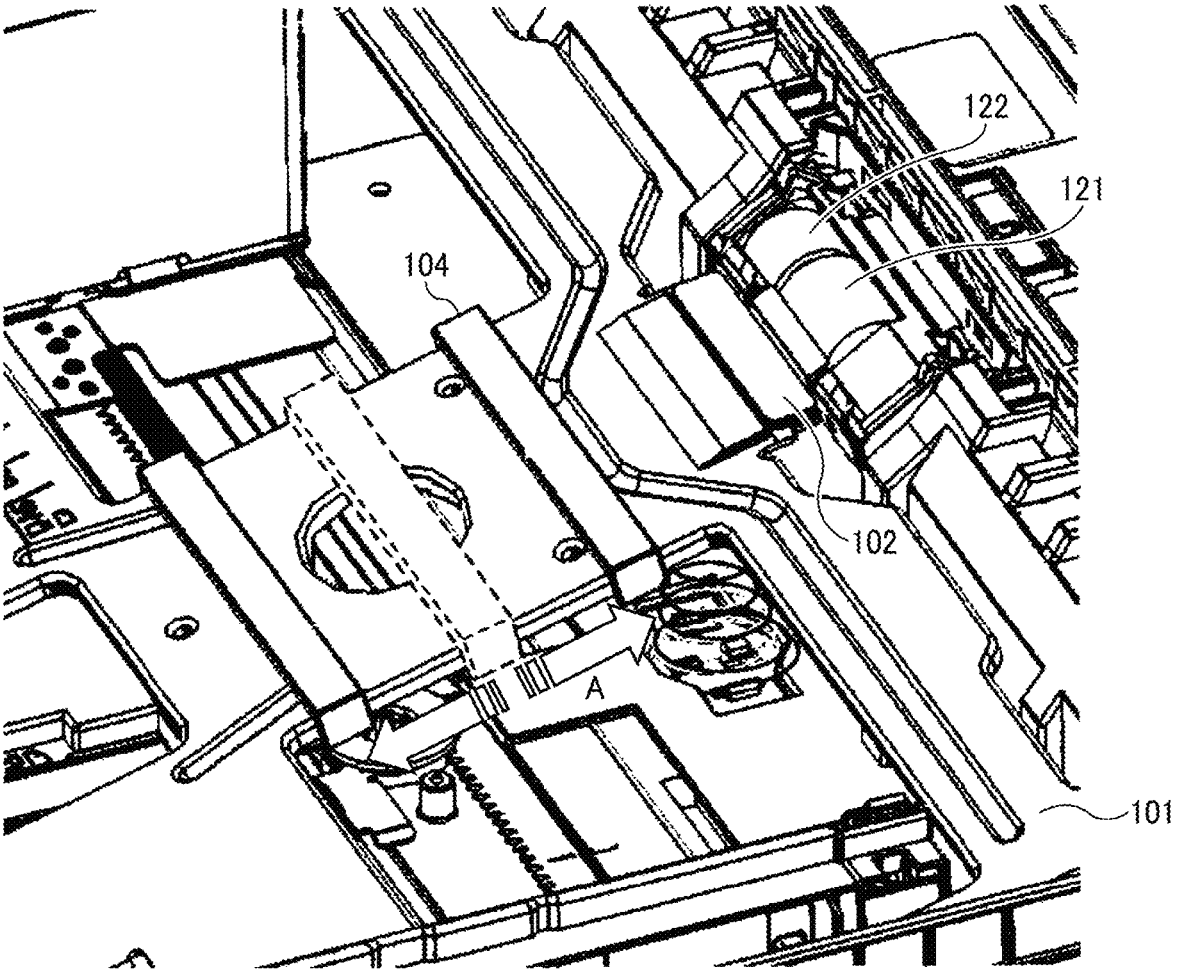
FIG. 31 is an enlarged perspective view illustrating a sliding action of the curl correcting body supported by a movable bottom plate of the sheet tray.

As illustrated in FIG. 30, the curl correcting body 104 is detachably attachable to the movable bottom plate 101 of the sheet tray 100. Further, as illustrated in FIG. 31, the curl correcting body 104 slides forward and backward in the sheet feeding direction (indicated by arrow A in FIG. 31) while being supported and engaged with the movable bottom plate 101.

Figure 32:
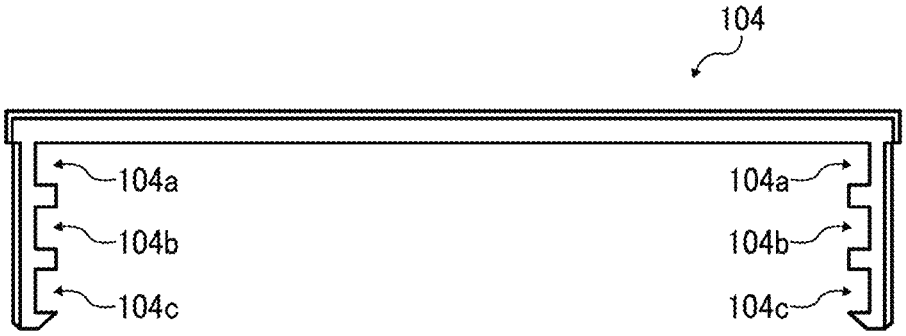
FIG. 32 is a front view illustrating the curl correcting body.

Further, as illustrated in FIG. 32, the curl correcting body 104 includes a first engaging part 104*a*, a second engaging part 104*b*, and a third engaging part 104*c*, each functioning as an engaging part that engages with the movable bottom plate 101. With the three engaging parts 104*a*, 104*b*, and 104*c*, the curl correcting body 104 has different amounts of projection from the sheet loading face 101*a* of the movable bottom plate 101 of the sheet tray 100.

Of the three engaging parts 104*a*, 104*b*, and 104*c*, the first engaging part 104*a* engages with the movable bottom plate 101 to adjust the curl correcting body 104 to have a smallest amount of projection from the sheet loading face 101*a* of the sheet tray 100. The second engaging part 104*b* engages with the movable bottom plate 101 to adjust the curl correcting body 104 to have a second smallest amount of projection from the sheet loading face of the sheet tray 100. The third engaging part 104*c* engages with the movable bottom plate 101 to adjust the curl correcting body 104 to have a largest amount of projection from the sheet loading face of the sheet tray 100.

The curl correcting body 104 have different degrees to correct the alignment and position of the sheet S depending on positions of the curl correcting body 104 in the sheet feeding direction A on the movable bottom plate 101 and on amounts of projection from the sheet loading face of the sheet tray 100. As illustrated in FIG. 29, when the entire area of the leading end in the perpendicular feed direction of the sheet S stored in the sheet tray 100 closely contacts the sheet loading face of the sheet tray 100, abutment of the sheet S to the sheet feed roller unit case 39 can be prevented. Specifically, occurrence of misfeed due to abutment can be avoided.

However, in order to correct the sheet S to a correct alignment as illustrated in FIG. 29, the positions and amounts of projection are set to a value according to the rigidity of the sheet S. Therefore, the curl correcting body 104 is slidably engaged with the movable bottom plate 101 as illustrated in FIG. 31 and multiple engaging parts (i.e., the first engaging part 104*a*, the second engaging part 104*b*, and the third engaging part 104*c*) are attached to the curl correcting body 104 as illustrated in FIG. 32. Accordingly, the position and amount of position of the sheet S are finely adjusted respectively to a value appropriate to the sheet rigidity of the sheet S and, as a result, occurrence of the misfeed due to abutment can be prevented reliably.

Figure 33:
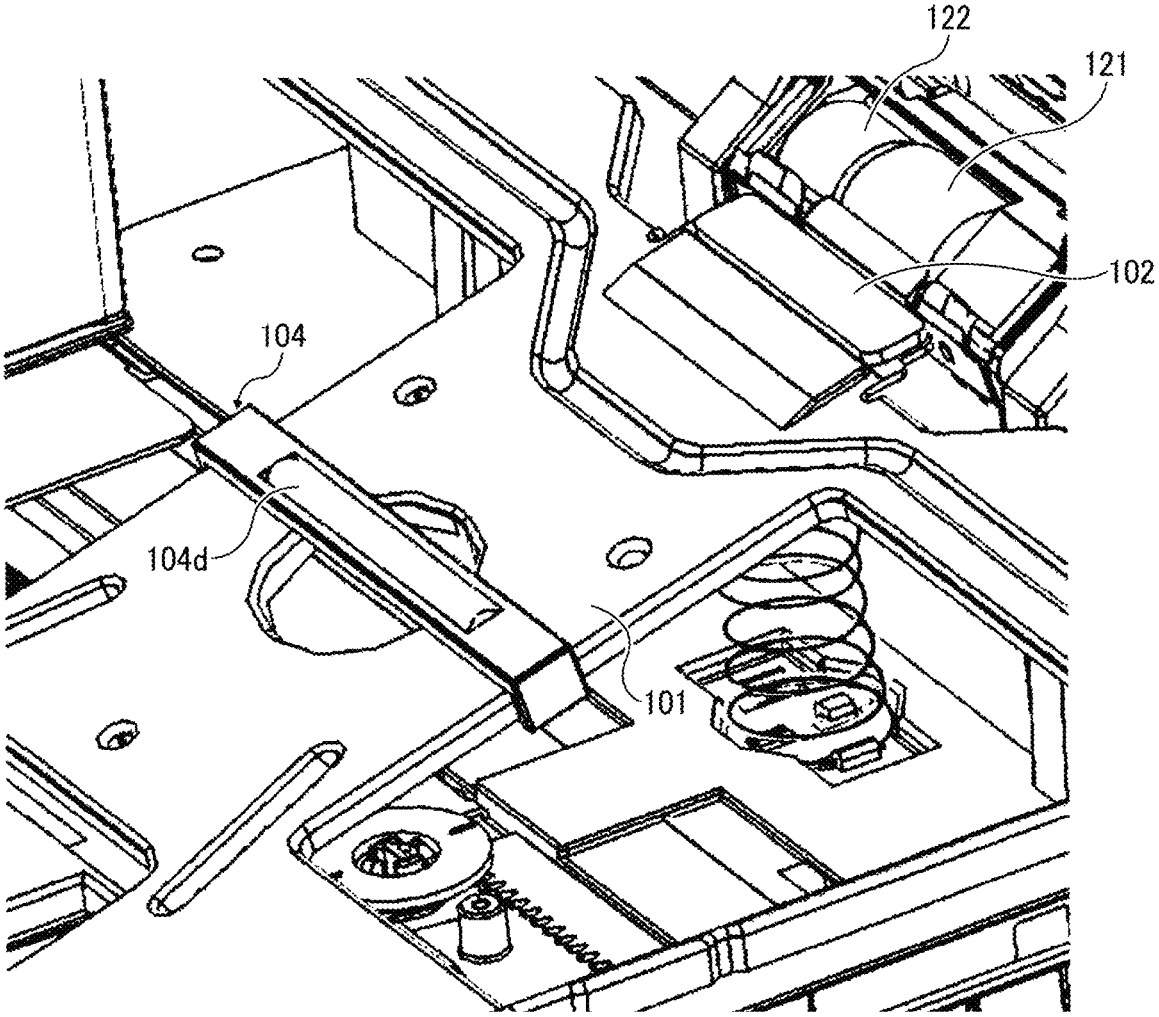
FIG. 33 is a perspective view illustrating the curl correcting body according to another example of this disclosure, together with the movable bottom plate of the sheet tray.

FIG. 33 is a perspective view illustrating the curl correcting body 104 according to another example of this disclosure, together with the movable bottom plate 101 of the sheet tray 100.

As illustrated in FIG. 33, the curl correcting body 104 may include a roller 104*d* to press the sheet S from below in the direction of gravitation. When a lowermost sheet S of sheet bundle in the sheet tray 100 is fed from the sheet tray 100, the roller 104*d* is rotated along with movement of the lowermost sheet S, and therefore can avoid a slidable contact of the sheet S and the curl correcting body 104. Accordingly, an increase in sheet conveyance resistance and occurrence of damage or scratch to the sheet S due to the slidable contact can be avoided.

Figure 34:
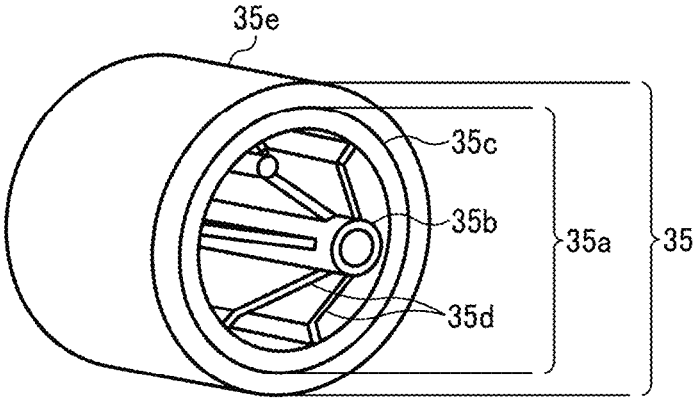
FIG. 34 is a perspective view illustrating the sheet feed roller.

FIG. 34 is a perspective view illustrating the sheet feed roller 35.

As illustrated in FIG. 34, the sheet feed roller 35 includes a hub 35*a*, an elastic layer 35*e*, and a metallic roller shaft.

The hub 35*a* is formed by a resin material and includes an inner ring 35*b*, an outer ring 35*c* that includes the inner ring 35*b*, and six ribs 35*d*, each extending radially from an outer circumferential surface of the inner ring 35*b* and connecting to an inner circumferential surface of the outer ring 35*c*.

The elastic layer 35*e* is formed by a rubber material body and covers the outer circumferential surface of the outer ring 35*c* of the hub 35*a*.

The metallic roller shaft is rotatably supported by respective bearings at both ends in a longitudinal direction thereof in a state in which the metallic roller shaft is set into an inside space of the inner ring 35*b* of the hub 35*a*.

The hub 35*a* has a hollow shaped configuration made of a resin material. Since a resin member is easy to mold, the hub 35*a* can be manufactured at low cost. However, due to its light weight, as the sheet feed roller 35 rotates, the hub 35*a* vibrates at high frequency, resulting in causing noise.

Figure 35:
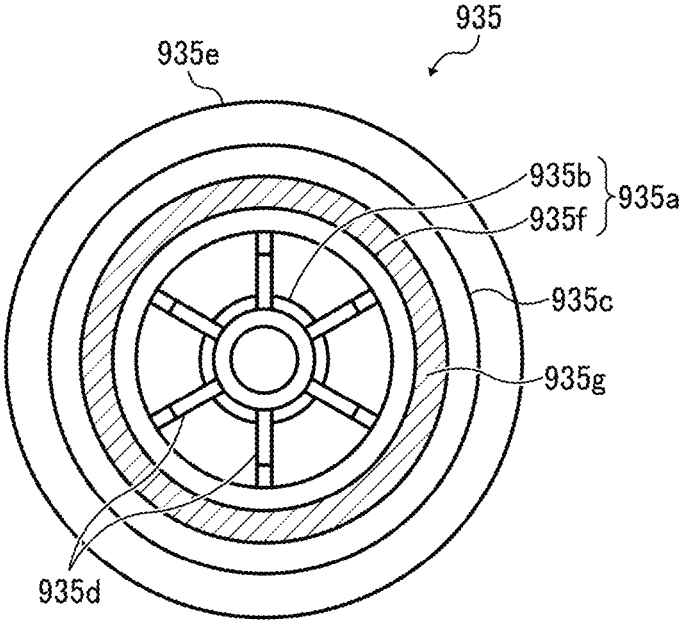
FIG. 35 is a side view illustrating a comparative roller.

FIG. 35 is a side view illustrating another example of a sheet feed roller 935 that can reduce the above-described inconvenience.

As illustrated in FIG. 35, the sheet feed roller 935 includes a hub 935*a*, an elastic layer 935*e*, and a roller shaft.

The hub 935*a* includes an inner ring 935*b*, an outer ring 935*c*, and a center ring 935*f* disposed between the inner ring 935*b* and the outer ring 935*c*.

The elastic layer 935*e* is formed by a rubber material body and covers the outer circumferential surface of the outer ring 935*c* of the hub 935*a*.

The roller shaft is rotatably supported by respective bearings at both ends in a longitudinal direction thereof in a state in which the metallic roller shaft is set into an inside space of the inner ring 935*b* of the hub 935*a*.

The sheet feed roller 935 further includes multiple ribs 935*d* that extends from an outer circumferential surface of the inner ring 935*b* to be connected to an inner circumferential surface of the center ring 935*f*.

There is a ring-shaped space formed between the center ring 935*f* and the outer ring 935*c*. The ring-shaped space does not include the ribs 935*d* but includes a metallic weight 935*g* pressed therein. The weight 935*g* contributes to an increase in the whole weight of the sheet feed roller 935. Accordingly, vibration of the sheet feed roller 935 is prevented, which can reduce occurrence of noise.

It is to be noted that FIG. 35 is a side view of the sheet feed roller 935 viewed from one end in the rotation axis direction of the sheet feed roller 935 and is not a cross sectional view thereof. However, the metallic weight 935*g* in FIG. 35 is illustrated in hatching for visual convenience.

However, the sheet feed roller 935 has an inconvenience that, when the sheet feed roller 935 is used in an image forming apparatus that is superior to a reduction in noise, the weight 935*g* is not fitted into the sheet feed roller 935 so as to achieve higher operability. However, if the weight 935*g* is not fitted into the sheet feed roller 935, the shape of the sheet feed roller 935 can easily be deformed. Specifically, when the weight 935*g* is not fitted into the sheet feed roller 935, a hollow part is formed between the center ring 935*f* and the outer ring 935*c*. Since the hollow part is supposed to receive the weight 935*g* therein, no ribs can be provided between the center ring 935*f* and the outer ring 935*c*. Therefore, the outer ring 935*c* of the sheet feed roller 935 can be radially deformed easily when compared with a configuration having ribs therebetween. Especially when a nip region is formed while pressing a different roller to the sheet feed roller 935, it is likely that the outer ring 935*c* of the sheet feed roller 935 inclines or tilts toward the rotation center of the sheet feed roller 935 due to a nip pressure, so that the sheet feed roller 935 can deform. By contrast, when the weight 935*g* is fitted into the sheet feed roller 935, this insertion of the weight 935*g* can expand the outer ring 935*c* outwardly, so that the outer diameter of the sheet feed roller 935 can increase in size.

To address the above-described inconveniences, the sheet feed roller 35 of the image forming apparatus 1000 according to the examples of this disclosure does not employ the configuration having the center ring 935*f*.

Figure 36:
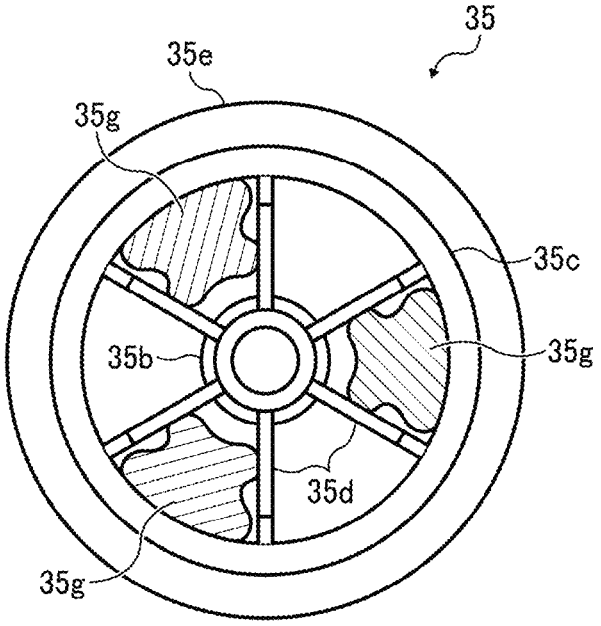
FIG. 36 is a side view illustrating the sheet feed roller of the image forming apparatus according to an example of this disclosure.

FIG. 36 is a side view illustrating the sheet feed roller 35 of the image forming apparatus 1000, viewed from one end side in the rotation axis direction of the sheet feed roller 35.

As illustrated in FIG. 36, the sheet feed roller 35 includes weights 35*g*. Each of the weights 35*g* is fitted into a space formed between two adjacent ribs 35*d* of the multiple ribs 35*d*. There are six (6) spaces divided by the ribs 35*d* (hereinafter, each space is referred to a rib partition space). Of the six rib partition spaces, three spaces include the respective weights 35*g* therein.

To avoid extreme deviation of the weights 35*g*, the rib partition space having the weight 35*g* therein and the rib partition space not having the weight 35*g* therein are alternately arranged in the rotational direction of the sheet feed roller 35.

According to this configuration, the outer ring 35*c* is fixedly reinforced by the ribs 35*d*. Therefore, even if the weight 35*g* is not fitted into the rib partition space, it is not likely to deform the outer ring 35*c*. Therefore, the operability of the sheet feed roller 35 can be increased.

It is to be noted that, similar to FIG. 35, FIG. 36 is not a cross sectional view thereof. However, the weights 35*g* in FIG. 36 is illustrated in hatching for visual convenience.

Further, even if the weight 35*g* is fitted into the rib partition space, since the outer ring 35*c* is reinforced by the ribs 35*d*, it is not likely to expand the outer ring 35*c* outwardly, and therefore an increase in size of the outer diameter of the sheet feed roller 35 can be avoided.

Figure 37:
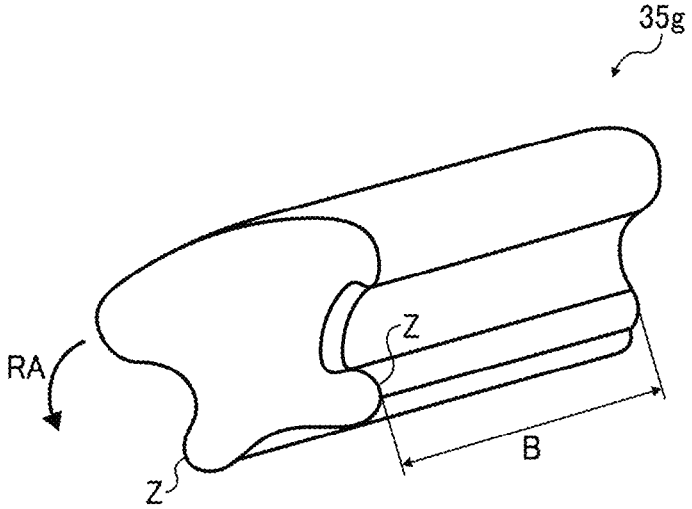
FIG. 37 is an enlarged view illustrating a weight that is attached to the sheet feed roller of FIG. 36.

FIG. 37 is an enlarged view illustrating one of the weights 35*g* attached to the sheet feed roller 35 of FIG. 36. A direction indicated by arrow RA in FIG. 37 is a rotation direction of the sheet feed roller 35. A direction indicated by arrow B in FIG. 37 is the rotation axis direction of the sheet feed roller 35.

Each of the weights 35*g* includes a projection Z at both ends in the rotation direction of the sheet feed roller 35. The projections Z extend on the entire region in the rotation axis direction B of the weight 35*g*.

Figure 38:
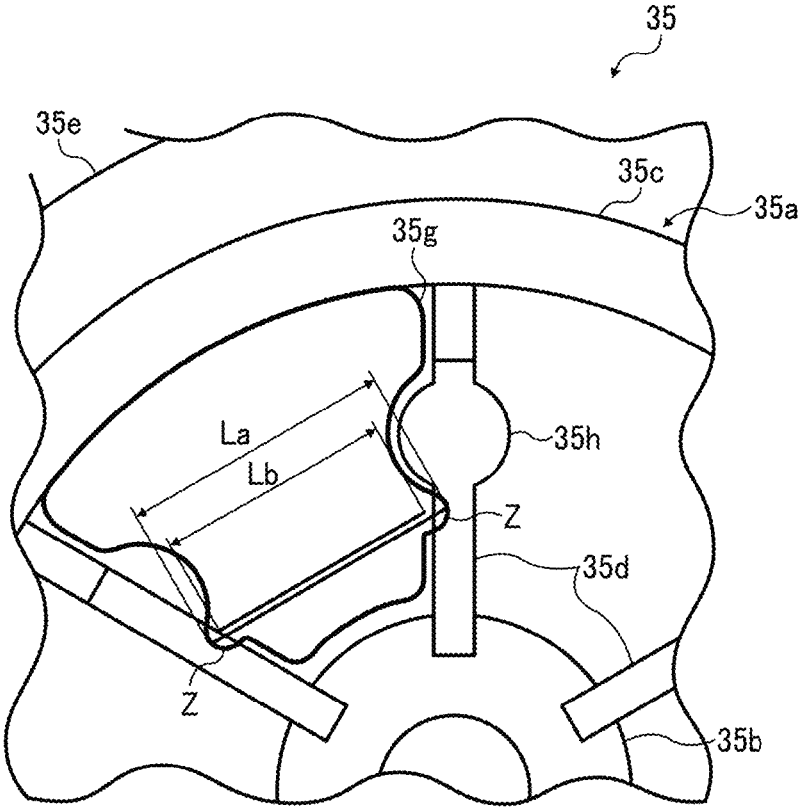
FIG. 38 is a partial enlarged side view illustrating a rib partition space of the sheet feed roller.

FIG. 38 is a partial enlarged side view illustrating a rib partition space of the sheet feed roller 35.

It is preferable that the weights 35*g* are closely fixed in the respective rib partition spaces so as to avoid rattling in the respective rib partition space. Since a centrifugal force is applied to each of the multiple weights 35*g* disposed in the corresponding rib partition spaces in a centrifugal direction, if the multiple weights 35*g* are disposed at respective positions away from the inner circumferential surface of the outer ring 35*c*, it is likely that the multiple weights 35*g* are due to a large centrifugal force removes the multiple weights 35*g* from the respective rib partition spaces.

To prevent this inconvenience, the weight 35*g* is closely attached to the inner circumferential surface of the outer ring 35*c*.

Specifically, as illustrated in FIG. 38, a reference sign "La" represents a projection distance or a distance between the projections Z, which is indicated as a distance between a leading end of one of the projections Z and a leading end of the other of the projections Z and a reference sign "Lb" represents a rib distance or a distance between the adjacent ribs 35*d* at the positions Z of the weight 35*g*. The distance Lb indicates a distance between a contact position at which one of the projections Z of the weight 35*g* in the rib partition space contacts one of the two adjacent ribs 35*d* and a contact position at which the other of the projections Z of the weight 35*g* in the rib partition space contacts the other of the two adjacent ribs 35*d*. As illustrated in FIG. 38, the projection distance La between the leading ends of the projections Z of the weight 35*g* is greater than the rib distance Lb between the ribs 35*d* at the respective contact positions.

In FIG. 38, the projections Z of the weight 35*g* are illustrated as if the projections Z cut in the inside of the ribs 35*d* for convenience. However, the weight 35*g* having the projection distance La greater than the rib distance Lb is fit into the rib partition space due to not cutting in the ribs 35*d* but due to bending of the ribs 35*d*. By so doing, each of the respective weights 35*g* closely fitted in the space formed between the adjacent ribs 35*d*.

It is to be noted that, even though the weight 35*g* has a single projection Z, if the weight 35*g* is formed such that the single projection Z abuts against the corresponding rib 35*d* reliably, the weight 35*g* can be fitted into the rib partition space reliably.

It is preferable that the projection Z is disposed to abut against a center of the rib 35*d* in a roller radial direction of the rib 35*d*. According to this structure, abutment of the projection Z can bend the rib 35*d* easily, which can enhance operability to fixedly fit the weight 35*g* in the rib partition space. Further, by bending the rib 35*d* relatively significantly by abutment of the projection Z, the weight 35*g* can be fixedly fitted into the rib partition space without rattling regardless of expansion and shrink of the weight 35*g* due to environmental changes.

In order to bend the rib 35*d* by abutment of the weight 35*g*, it is preferable that any rib partition space located adjacent to the rib partition spaces having the weight 35*d* therein remains open without the weight 35*g*. Further, for the purpose of maintaining an even weight balance in a circular direction, it is preferable that the rib partition spaces having the respective weights 35*g* and the rib partition spaces not having the weights 35*g* are arranged alternately. In order to achieve these two purposes concurrently, it is preferable that the number of the rib partition spaces is even.

As illustrated in FIG. 38, the hub 35*a* made of a resin material further includes a gate circular part 35*h* that is generated in molding. Even if such the gate circular part 35*h* is generated, the weight 35*g* can be formed in a shape that can avoid the gate circular part 35*h*. By so doing, the weight 35*g* can be set into the rib partition space without cutting and removing the gate circular part 35*h*.

It is to be noted that a sub rib can be provided over and between adjacent ribs 35*d*, so that an inside space and an outside space of the rib partition space in the roller radial direction can be divided. In this case, it is preferable that the weight 35*g* is fitted into the outside space in order to achieve an effect to reduce relatively large noise with a relatively small weight 35*g*.

As illustrated in FIG. 37, the projections Z of the weight 35*g* extend over the whole area of the weight 35*g* in the rotation axis direction. By so doing, when the weights 35*g* are inserted into the respective rib partition spaces, the projection Z is not caught by the adjacent ribs 35*d* in the course of insertion of the weights 35*g*. Therefore, a performance of insertion of the weights 35*g* can be enhanced.

Figure 39:
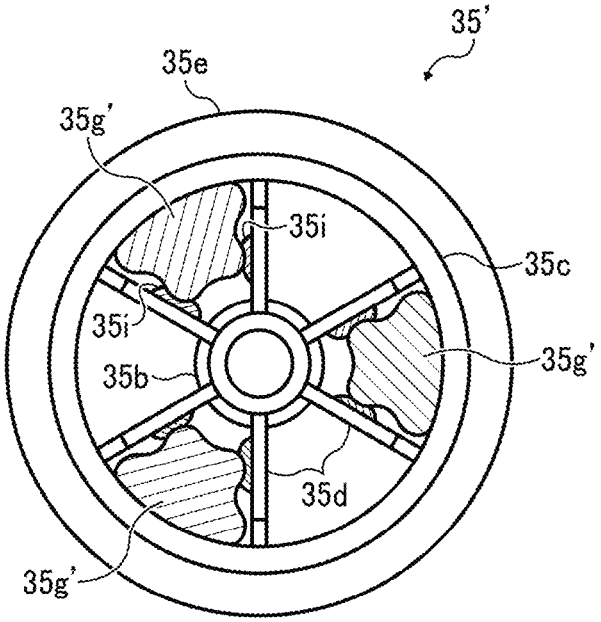
FIG. 39 is a side view illustrating a sheet feed roller of an image forming apparatus according to another example of this disclosure.

FIG. 39 is a side view illustrating a sheet feed roller 35' of the image forming apparatus 1000 according to another example of this disclosure.

As illustrated in FIG. 39, each of weights 35*g*' provided to the sheet feed roller 35' does not include any projections. Therefore, respective spaces are formed between each of the weights 35*g*' that is in close contact with the outer ring 35*c* and each of the two adjacent ribs 35*d*. By filling the spaces using adhesive 35*i*, the weights 35*g*' are attached to the respective ribs 35*d*.

The adhesive 35*i* is made of a member obtaining elasticity after hardening and preventing peeling due to difference of shrinkage of a metallic body and a resin hub due to environmental changes.

It is to be noted that, similar to FIG. 35, FIG. 39 is not a cross sectional view thereof. However, the weights 35*g*' in FIG. 39 is illustrated in hatching for visual convenience.

The above-described configurations are examples. This disclosure can achieve the following aspects effectively.

Aspect A.

In Aspect A, an image forming apparatus (for example, the image forming apparatus 1000) has a configuration that includes a sheet container (for example, the sheet tray 100), a sheet separating feeder (for example, the sheet separating part 210), an image forming part (for example, the image forming part 200), and a bend applier (for example, the bend applying member 127*b*). The sheet container accommodates a sheet bundle (for example, the multiple sheets S) including a recording medium (for example, the sheet S, the uppermost sheet S) therein. The sheet separating feeder includes a sheet feeding body (for example, the sheet feed roller 35) and a sheet separating body (for example, the sheet separating roller 121). The sheet feeding body feeds the recording medium from the sheet container along with movement of a surface thereof while the recording medium contained in the sheet container is in contact with the surface thereof.

The sheet separating body forms a sheet separation nip region by contacting the sheet feeding body and to sandwich the recording medium fed from the sheet separation nip region. The sheet separating feeder separates and feeds the recording medium in contact with the sheet feeding body. The image forming part forms an image on the recording medium that is fed and separated by the sheet separating feeder. The bend applier contacts and bends the recording medium before the recording medium enters the sheet separation nip region and generates a wrinkle extending in a sheet conveying direction. The bend applier has a leading end (for example, the leading end 127*d*) of an elastic material (for example, the resin sheet RS) to contact the recording medium.

According to this configuration of Aspect A, in the image forming apparatus having a pickup-less structure, the bend applier generates wrinkles extending in the sheet conveying direction of the recording medium before the recording medium enters the sheet separation nip region. By so doing, generation of bends in the direction perpendicular to the sheet conveying direction of the recording medium can be prevented. Waves on the recording medium are generated due to bends of the recording medium in the sheet conveying direction over multiple areas of the recording medium. Therefore, prevention of generation of bends of the recording medium can eliminate generation of waves on the recording medium. Accordingly, by preventing generation of waves on the recording medium in the vicinity of the sheet separation nip region, generation on creases of the recording medium having a small rigidity can be prevented.

Further, in the configuration of Aspect A, the leading end of the bend applier is formed by an elastic material and flexibly bends when contacting the recording medium having a large rigidity before the sheet separation nip region. This bend of the leading end of the bend applier can reduce an amount of projection of the recording medium by the bend applier at a position before the sheet separation nip region.

Accordingly, a pressing area in which the recording medium is pressed to the surface of the sheet feeding body before the sheet separation nip region can be reduced, which restricts occurrence of slip of the recording medium having a large rigidity on the surface of the sheet feeding body. As a result, occurrence of misfeed due to slip can be prevented.

In Aspect A, the image forming apparatus further includes a sheet conveying path (for example, the sheet conveying path 42) through which the recording medium is conveyed. The bend applier is disposed to contact the leading end thereof to the recording medium before the sheet separation nip region from below in a direction of gravitation. The leading end of an entire part of the bend applier is projected upward in the direction of gravitation and higher than the sheet conveying path from the sheet container toward the sheet separation nip region.

According to this configuration of Aspect B, as described in the above-described examples, the leading end of the bend applier generates wrinkles extending in the sheet conveying direction on the recording medium reliably. As a result, generation of the misfeed due to slip can be prevented reliably.

Aspect B.

In Aspect A, the image forming apparatus further includes a sheet conveying path (for example, the sheet conveying path 42) through which the recording medium is conveyed. The bend applier is disposed to contact the leading end thereof to the recording medium before the sheet separation nip region from below in a direction of gravitation. The leading end of an entire part of the bend applier is projected upward in the direction of gravitation and higher than the sheet conveying path from the sheet container toward the sheet separation nip region.

According to this configuration of Aspect B, as described in the above-described examples, the leading end of the bend applier generates wrinkles extending in the sheet conveying direction on the recording medium reliably. As a result, generation of the misfeed due to slip can be prevented reliably.

Aspect C.

In Aspect B, the bend applier of the image forming apparatus further includes a body (for example, the body 127*c*), a body forming member (for example, the sheet metal SM) to form the body, and a leading end forming member (for example, the resin sheet RS) to form the leading end while being attached to the body.

According to this configuration of Aspect C, as described in the above-described examples, the leading end forming member can easily provide a desired flexibility to the leading end of the bend applier as designed.

Aspect D.

In Aspect C, both the body forming member and the leading end forming member respectively include an upright portion (for example, the upright portion α), a bent portion (a bent portion β), and a leading extended portion (for example, the leading extended portion γ). The upright portion extends upwardly in a direction of gravitation. The bent portion is bent from the sheet container toward the sheet separation nip region at an upward end position of the upright portion in the sheet conveying direction. The leading extended portion extends from the bent portion toward the leading end. A surface of the upright portion of the leading end forming member in the sheet conveying direction on a side of the sheet container is fixedly attached to a surface of the upright portion of the body forming member in the sheet conveying direction on a side of the sheet separation nip region. The leading extended portion of the leading end forming member is supported by the bent portion of the leading end forming member in a cantilever manner without being attached to the leading extended portion of the body forming member in a state in which the leading extended portion of the leading end forming member is disposed below the leading extended portion of the body forming member in the direction of gravitation.

According to the configuration of Aspect D, as described in the above-described examples, compared to the case in which the leading extended portion of the leading end forming member is attached to the lower surface of the leading extended portion of the body forming member, the leading end of this configuration of Aspect C can be bent preferably. As a result, occurrence of misfeed due to slip can be prevented preferably.

Aspect E.

In any of Aspects A through D, the bend applier of the image forming apparatus includes multiple bend appliers (for example, the multiple bend applying members 127*b*) contacting the recording medium at different positions in a direction perpendicular to the sheet conveying direction.

According to this configuration of Aspect E, the multiple bend appliers generate multiple wrinkles aligned in the direction perpendicular to the sheet conveying direction of the recording medium. Accordingly, wave formation on the recording medium is prevented by a greater force applied by the multiple bend appliers, and therefore generation on crease of the recording medium can be prevented reliably.

Aspect F.

In Aspect E, the sheet separating body of the image forming apparatus is a sheet separating roller (for example, the sheet separating roller 121) having a cylindrical roller part (for example, the roller part 121*b*). At least one of the multiple bend appliers is located at a position shifted to one side of the cylindrical roller part in a rotation axis direction and another of the multiple bend appliers is located at a position shifted to the other side of the roller part in the rotation axis direction.

According to this configuration of Aspect F, as described in the above-described examples, generation of crease on the recording medium caused by wrinkles formed by the bend appliers.

Aspect G.

In any of Aspects A through F, the image forming apparatus further includes a sheet separation nip guide (for example, the sheet separation nip guide 127*a*) to contact the recording medium before the sheet separation nip region and to prevent the recording medium from hitting against the sheet separating body before the sheet separation nip region and guide the recording medium toward the sheet separation nip region.

According to this configuration of Aspect G, as described in the above-described examples, the sheet separation nip guide prevents abutment of the recording medium against the sheer separating body, and therefore occurrence of misfeed due to abutment can be prevented.

Aspect H.

In Aspect G, the separation nip region guide includes a guide part (for example, the guide part 127*a*1). The guide part of the separation nip region guide extends in a different direction from a direction in which the leading end of the bend applier extends.

According to this configuration of Aspect H, as described in the above-described examples, the following two functions are preferably performed individually. Specifically, this configuration of Aspect H can provide a function in which the separation nip guide guides the recording medium to the sheet separation nip region and another function in which the bend applier causes the recording medium to have wrinkles on the recording medium to prevent generation of waves on the recording medium.

Aspect I.

In any of Aspects A through H, the image forming apparatus further includes a sheet loading face (for example, the sheet loading face 101*a*) that is provided to the sheet container, and a curl correcting body (for example, the curl correcting body 104) that is attached to the sheet container and corrects curling of the recording medium. The curl correcting body is disposed projecting upward above the sheet loading face and detachably attached to the sheet container by contacting a center part of the recording medium in the sheet container in a direction perpendicular to a sheet feeding direction.

According to this configuration of Aspect I, as described in the above-described examples, occurrence of misfeed due to curled sheet can be prevented.

Aspect J.

In Aspect I, the curl correcting body includes multiple engaging parts (for example, the first engaging part 104*a*, the second engaging part 104*b*, and the third engaging part 104*c*) to provide different amounts of projection thereof from the sheet loading face of the sheet container.

According to this configuration of Aspect J, as described in the above-described examples, the amount of projection of the curl correcting body from the sheet loading face of the sheet container can be finely adjusted depending on the rigidity of the recording medium. As a result, occurrence of misfeed due to abutment can be prevented reliably.

Aspect K.

In any of Aspects A through J, the sheet feeding body of the image forming apparatus includes an inner ring (for example, the inner ring 35*b*), an outer ring (for example, the outer ring 35*c*), multiple ribs (for example, the ribs 35*d*), an elastic layer (for example, the elastic layer 35*e*), and multiple weights (for example, the weights 35*g*). The outer ring includes the inner ring therein. Each of the multiple ribs extends radially from an outer circumferential surface of the inner ring and connects to an inner circumferential surface of the outer ring. The elastic layer is formed by an elastic body covering the outer circumferential surface of the outer ring. Each of the multiple weights is fixedly provided in a space (for example, the rib partition space) formed between two adjacent ribs of the multiple ribs disposed inside the outer ring.

According to this configuration of Aspect K, as described in the above-described examples, the operability of the sheet feeding body can be increased and expansion of an outer diameter of the sheet feeding body due to insertion of the weights can be avoided.

Aspect L.

In Aspect K, each of the multiple weights has two opposite surfaces in the rotation direction of the sheet feeding body, which are one end surface having one projection (for example, the projection Z) and the other end surface having the other projection (for example, the projection Z). The one projection contacts one of the two adjacent ribs disposed sandwiching the space formed therebetween and the other projection contacts the other of the two adjacent ribs. A different portion from the one projection and the other projection of each of the multiple weights contacts the inner circumferential surface of the outer ring.

According to the configuration of Aspect L, the weights can be prevented from rattling in the space.

Aspect M.

In Aspect L, a distance between the two adjacent ribs at contact positions defined by a straight line connecting a contact position at which the one projection of each of the weights contacts one of the two adjacent ribs and a contact position at which the other projection of each of the weights contacts the other of the two adjacent ribs is smaller than a distance between the leading ends of each weight provided between the two adjacent ribs.

According to this configuration of Aspect M, the weights are pressed into the space and closely fixed thereto.

Aspect N.

In Aspect M, each of the projections extends over the entire area of the weights in the rotation axis direction of the sheet feeding body.

According to this configuration of Aspect N, when the weights are inserted into the space formed between the two adjacent ribs of the multiple ribs, the projection is not caught by the adjacent ribs in the course of insertion of the weights. Therefore, a performance of insertion of the weights can be enhanced.

Aspect O.

In Aspect K, the weights are fixedly provided to the ribs by using an adhesive (for example, an adhesive 35*i*).

According to this configuration of Aspect O, the weights can be fixedly provided to the ribs without deforming the shape of the ribs.

Aspect P.

In any of Aspects K through O, the weights are formed in a shape avoiding a gate part (for example, the gate circular part 35*h*) that is formed when molding a hub (for example, the hub 35*a*) including the inner ring, the outer ring, and the multiple ribs.

According to this configuration of Aspect P, the weights are inserted into the respective spaces of the sheet feeding body without removing the gate part by cutting or other processes, and therefore a reduction in manufacturing cost can be achieved.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet separating feeder, comprising:

a sheet feeding body having a surface to contact a sheet and configured to feed the sheet;

a sheet separating body configured to contact the sheet feeding body from below and form a sheet separation nip region with the sheet feeding body, and to sandwich the sheet in the sheet separation nip region;

a leading end forming member having a leading end including elastic material to contact the sheet, the leading end forming member including a leading extended portion extending from a base end portion of the leading end forming member, the base end portion of the leading end forming member having a first face on a contact side to contact a leading end of the sheet, the first face attached to a surface of a first body forming member, an uppermost part of the first body forming member being lower than an uppermost part of the leading end forming member, the base end portion of the leading end forming member being located below the uppermost part of the first body forming member, the leading extended portion of the leading end forming member not being attached to the first body forming member, the base end portion of the leading end forming member having a second face on a side opposite the contact side, the second face attached to a surface of a second body forming member; and a projection configured to contact the sheet, the projection being disposed outside a side end of the sheet separating body in a direction perpendicular to a sheet conveying direction, the entirety of the projection being disposed outside a side end of the leading end forming member in the direction perpendicular to the sheet conveying direction.

2. The sheet separating feeder according to claim 1, wherein the leading end of the leading end forming member is projected upward.

3. The sheet separating feeder according to claim 2, wherein the leading end of the leading end forming member includes multiple leading ends of the leading end forming member configured to the sheet at different positions in a direction perpendicular to the sheet conveying direction.

4. The sheet separating feeder according to claim 1, wherein the leading end of the leading end forming member includes multiple leading ends of the leading end forming member configured to contact the sheet at different positions in a direction perpendicular to the sheet conveying direction.

5. The sheet separating feeder according to claim 4, wherein at least one of the multiple leading ends of the leading end forming member is located at a position shifted to one side of the sheet separating body in a direction perpendicular to the sheet conveying direction and another of the multiple leading ends of the leading end forming member is located at a position shifted to the other side of sheet separating body in the direction perpendicular to the sheet conveying direction.

6. The sheet separating feeder according to claim 4, further comprising a sheet separation nip guide disposed between two of the multiple leading ends of the leading end forming member.

7. The sheet separating feeder according to claim 6, wherein the sheet separation nip guide includes a guide part, and wherein the guide part of the sheet separation nip guide extends in a direction different from a direction in which the leading end forming member extends.

8. The sheet separating feeder according to claim 1, further comprising a guide panel having a sheet separation nip guide configured to contact the sheet before the sheet separation nip region and to prevent the sheet from hitting against the sheet separating body before the sheet separation nip region and guide the sheet toward the sheet separation nip region.

9. An image forming apparatus, comprising:

the sheet separating feeder according to claim 1, and a sheet container.

10. A sheet separating feeder, comprising:

a sheet feeding body having a surface to contact a sheet and configured to feed the sheet;

a sheet separating body configured to contact the sheet feeding body from below and form a sheet separation nip region with the sheet feeding body, and to sandwich the sheet in the sheet separation nip region;

a leading end forming member having a leading end including elastic material to contact the sheet, the leading end forming member including a leading extended portion extending from a base end portion of the leading end forming member, the base end portion of the leading end forming member having a first face on a contact side to contact a leading end of the sheet, the first face attached to a surface of a first body forming member, an uppermost part of the first body forming member being lower than an uppermost part of the leading end forming member, the base end portion of the leading end forming member being located below the uppermost part of the first body forming member, the leading extended portion of the leading end forming member not being attached to the first body forming member, the base end portion of the leading end forming member having a second face on a side opposite the contact side, the second face attached to a surface of a second body forming member; and a projection configured to contact the sheet from below, the projection being disposed outside a side end of the sheet separating body in a direction perpendicular to the sheet conveying direction, the projection being disposed outside a side end of the leading end forming member in the direction perpendicular to the sheet conveying direction, the projection being disposed from a downstream side to an upstream side in the sheet conveying direction across the sheet separation nip region.

11. An image forming apparatus, comprising:

the sheet separating feeder according to claim 10, and a sheet container.

12. A sheet separating feeder, comprising:

a sheet feeding body having a surface to contact a sheet and configured to feed the sheet;

a sheet separating body configured to contact the sheet feeding body from below and form a sheet separation nip region with the sheet feeding body, and to sandwich the sheet in the sheet separation nip region;

a leading end forming member disposed upstream from the sheet separation nip region in a sheet conveying direction, the leading end forming member having a leading end including elastic material to contact the sheet, the leading end forming member including a leading extended portion extending from a base end portion of the leading end forming member, the base end portion of the leading end forming member having a first face on a contact side to contact a leading end of the sheet, the first face attached to a surface of a first body forming member, an uppermost part of the first body forming member being lower than an uppermost part of the leading end forming member, the base end portion of the leading end forming member being located below the uppermost part of the first body forming member, the leading extended portion of the leading end forming member not being attached to the first body forming member, the base end portion of the leading end forming member having a second face on a side opposite the contact side, the second face attached to a surface of a second body forming member; and a projection configured to contact the sheet, the projection being disposed outside a side end of the sheet separating body in a direction perpendicular to a sheet conveying direction, wherein a gap is formed between the projection and the leading end forming member in the direction perpendicular to the sheet conveying direction.

13. An image forming apparatus, comprising:

the sheet separating feeder according to claim 12, and a sheet container.

14. A sheet separating feeder, comprising:

a sheet feeder to feed the sheet;

a sheet separator to contact the sheet feeder from below, and to sandwich the sheet in a sheet separation nip region; and a leading end forming member disposed upstream from the sheet separation nip region in a sheet conveying direction, the leading end forming member including:

bases including a first base and a second base in the direction perpendicular to the sheet conveying direction;

a leading end extending from each of the bases and being disposed outside a side end of the sheet separator in a direction perpendicular to the sheet conveying direction, the leading end including an elastic material to contact the sheet and having a free end at a leading end portion in the sheet conveying direction;

a side projection being disposed outside a side end of each of the bases in the direction perpendicular to the sheet conveying direction; and a coupling portion disposed between the first base and the second base to couple the first base and the second base in the direction perpendicular to the sheet conveying direction.

15. An image forming apparatus, comprising:

the sheet separating feeder according to claim 14, and a sheet container.

16. The sheet separating feeder according to claim 14, wherein the first base, the second base, the coupling portion, and the leading end are made of resin and integrally formed as a single unit.

17. The sheet separating feeder according to claim 14, further comprising a guide unit panel including metal material and facing the first base and the second base facing.

* * * * *